US006275203B1

(12) United States Patent
Yamada

(10) Patent No.: US 6,275,203 B1
(45) Date of Patent: Aug. 14, 2001

(54) PLASMA DISPLAY PANEL WITH A STRUCTURE CAPABLE OF REDUCING VARIOUS NOISES

(75) Inventor: Hachiro Yamada, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/116,128

(22) Filed: Jul. 15, 1998

(30) Foreign Application Priority Data

Jul. 18, 1997 (JP) ..... 9-194241

(51) Int. Cl.[7] ..... G09G 3/28
(52) U.S. Cl. ..... 345/60; 345/67; 315/169.4
(58) Field of Search ..... 345/62, 65, 67, 345/68, 60, 66, 63; 315/169.1, 169.4

(56) References Cited

U.S. PATENT DOCUMENTS

| | | | | |
|---|---|---|---|---|
| 4,025,818 | * | 5/1977 | Giguere et al. | 315/337 |
| 4,320,418 | | 3/1982 | Pavliscak | 358/240 |
| 5,331,252 | | 7/1994 | Kim | 315/169.4 |
| 5,369,338 | * | 11/1994 | Kim | 315/169.4 |
| 5,952,783 | * | 9/1999 | Kuroki et al. | 313/590 |

FOREIGN PATENT DOCUMENTS

| | | |
|---|---|---|
| 2 266 007 | 10/1993 | (GB) . |
| 8-320667 | 12/1996 | (JP) . |
| 10-187091 | 7/1998 | (JP) . |
| 95-3132 | 4/1995 | (KR) . |

OTHER PUBLICATIONS

Performance of Color PDP to the Same Level of a CRT, Nikkei Electronics, Oct. 19, 1998 (No. 728).

* cited by examiner

*Primary Examiner*—Richard Hjerpe
*Assistant Examiner*—Alexander Eisen
(74) *Attorney, Agent, or Firm*—Sughrue, Mion, Zinn, Macpeak & Seas, PLLC

(57) ABSTRACT

The present invention relates to a plasma display panel of the surface discharge type and the AC type. In the plasma display panel of the present invention, scanning pulses are successively applied to a large number of scanning electrodes while data pulses are successively applied to a large number of data electrodes to write wall charge which corresponds to an image into pixels. Then, sustain pulses whose feeding directions are reversed between a first condition and a second condition which occur alternately are fed between the scanning electrodes and sustain electrodes so that discharge occurs at the positions of the pixels in which the wall charge is written to cause a phosphor to emit light to display the image. Since, when the surface discharge electrodes of a predetermined number of one or more rows arranged successively in the column direction are defined as a set, the feeding directions and the positive and negative polarities of the sustain pulses are made opposite between the surface discharge electrodes of odd-numbered sets and even-numbered sets, magnetic noises and electric field noises generated by feeding of the sustain pulses of a high voltage cancel each other, and consequently, such noises can be reduced.

49 Claims, 13 Drawing Sheets

PLASMA DISPLAY PANEL WITH A STRUCTURE CAPABLE OF REDUCING VARIOUS NOISES

BACKGROUND OF THE INVENTION

1. Field of the Invention

This invention relates to a plasma display panel, and more particularly to a plasma display panel of the AC (Alternating Current) type and the surface discharge type.

2. Description of the Related Art

Conventionally, various image display apparatus are utilized, and one of such image display apparatus is an apparatus called plasma display panel.

The plasma display panels an image by causing a phosphor to emit light by discharge and is anticipated as a display in the form of a flat plane which spontaneously emits light in a high luminance.

Plasma display panels of the type mentioned are divided into two types of a DC (Direct Current) type and an AC type. Since an AC plasma display panel has electrodes which are not exposed to a discharge space, it is superior in durability to a plasma display panel of the DC type whose electrodes are exposed to a discharge space.

Also AC plasma display panels are divided into two types including an opposing type and a surface discharge type. While electrodes of a plasma display panel of the opposing type which extend in perpendicular directions to each other are opposed to each other, a plasma display panel of the surface discharge type includes surface discharging electrodes which include scanning electrodes and sustain electrodes in combination and are arranged on a plane.

A plasma display panel of the surface discharge type of the AC type is anticipated as a large-size full-color flat display since it has a wide memory margin and a high light emission efficiency.

Such a plasma display panel of the surface discharge type of the AC type as described above is disclosed, for example, in Japanese Patent Laid-open No. 320667/96.

Japanese Patent Laid-open No. 320667/96 discloses that some wiring patterns are omitted by devising a driving method.

Here, the plasma display panel disclosed is described below as a conventional example with reference to FIGS. 1 to 3.

It is to be noted here that, in order to simplify the description, the horizontal direction of FIG. 1 is referred to as the row direction while the vertical direction is referred to as the column direction. The row direction is a direction parallel to the rows, and a plurality of columns are arranged successively in the row direction. The column direction is the direction parallel to the columns, and a plurality of rows are arranged in the column direction.

Plasma display panel 1 of the surface discharge type of the AC type described as an example here includes, as shown in FIG. 1, display panel 2 and drive circuit 3. Display panel 2 and drive circuit 3 are connected to each other.

On display panel 2, n surface discharge electrodes 11 parallel to the row direction are successively arranged in the column direction. Each of the surface discharge electrodes 11 is composed of scanning electrode 12 arranged at a higher location and sustain electrode 13 located at a lower location.

Positioned on the rear side of surface discharge electrodes 11 is discharge space 16 in which gas of a phosphor is enclosed. On the rear side of surface discharge electrodes 11, m data electrodes 14 parallel to the column direction are successively arranged in the row direction.

In particular, as shown in FIG. 2, scanning electrodes 12 and sustain electrodes 13 which compose surface discharge electrodes 11 are formed by printed wiring lines on the rear face of transparent substrate 17. Data electrodes 14 are formed from printed wiring lines on the front face of transparent substrate 18 formed as a separate member.

Phosphor 20 is positioned on the front face of each of data electrodes 14 with dielectric 19 interposed therebetween, and discharge space 16 is formed at a position opposing phosphor 20.

As described above, n surface discharge electrodes 11 and m data electrodes 14 extend perpendicularly to each other with discharge space 16 interposed therebetween. Each of n×m intersecting points between n surface discharge electrodes 11 and m data electrodes 14 with discharge space 16 interposed therebetween serves as pixel 15 which emits light individually.

As shown in FIG. 1, one scanning wiring line 21 is connected to the left ends of n scanning electrodes 12. One scanning driver 22 is connected to this one scanning wiring line 21.

One sustain wiring line 23 is connected commonly to the right ends of n sustain electrodes 13. One sustain driver 24 is connected to this one sustain wiring line 23.

m data drivers (not shown) are individually connected to m data electrodes 14. Drive circuit 3 is formed by such various drivers 22 . . . as described above.

It is to be noted that planar grounding electrodes (not shown) are formed on the rear faces of electrodes 12 to 14 arranged in such a manner as described above. A ground potential is applied to the grounding electrodes.

Plasma display panel 1 of the surface discharge type of the AC type having such a structure as described above can display a desired image in a dot matrix system by individually controlling n×m pixels arranged in a matrix so that they should or should not emit light.

Here, a driving method for plasma display panel 1 having the construction described above is described with reference to FIG. 3.

First, as a preparation operation, n scanning drivers 22 and one sustain driver 24 apply a predischarge pulse to n scanning electrodes 12 and sustain electrodes 13. Consequently, by the predischarge, display panel 2 is put into a condition wherein discharge of an image display is executed stably.

Then, n scanning drivers 22 apply scanning pulses SC1 to SCn, whose timings are successively shifted relative to each other, individually to n scanning electrodes 12, and in synchronism with the timings, the m data drivers apply data pulses to particular data electrodes 14 which correspond to an image to be displayed.

Consequently, the positions of all pixels 15 are successively scanned, and wall charge is written into only those pixels 15 which correspond to the image. Thus, n scanning drivers 22 apply sustain pulses B to all of n scanning electrodes 12, and single sustain driver 24 applies sustain pulses A to all of n sustain electrodes 13.

In this instance, since the generation timings of sustain pulses A applied to scanning electrodes 12 and sustain pulses B applied to sustain electrodes 13 are different from each other, a first condition wherein current flows from scanning electrodes 12 to sustain electrodes 13 as seen in FIG. 1 and a second condition (not shown) wherein current flows from sustain electrodes 13 to scanning electrodes 12 occur alternately.

Since the direction of sustain pulses supplied to surface discharge electrodes 11 is reversed between the first condition and the second condition, discharge occurs only at the positions of those pixels 15 to which the wall charge has been written, and only the phosphors of those pixels 15 emit light to display an image.

However, when an image is displayed in such a manner as described above, the sustain pulses to be applied to electrodes 12, 13 are required to have a peak value of approximately several hundreds volt and a frequency of several hundreds kilohertz since electrodes 12, 13 cause the phosphors to emit light by discharge.

In plasma display panel 1 described above, the feeding direction between electrodes 12, 13 is reversed between the first condition and the second condition. In particular, in the first condition, current is fed from the left to the right in all of surface discharge electrodes 11, and this is reversed in the second condition.

If current is fed in the same direction in the large number of surface discharge electrodes 11 in this manner, then since electric fields and magnetic fields are generated in high intensities, they have a bad influence as magnetic noise and electric field noise upon the surroundings.

Further, current supplied from one end of each of electrodes 12 to 14 flows through the other end of the electrode to the grounding wiring line on the rear face, and since a large amount of current flows through the grounding wiring lines, excessively high ground noise is generated.

Furthermore, when sustain pulses pass through surface discharge electrodes 11, since the potential difference between adjacent surface discharge electrodes 11 is large, discharge occurs between surf ace discharge electrodes 11 and wall charge is sometimes written in error into those pixels 15 which are not to be lit.

In this instance, since those pixels 15 which are not to be lit are lit in error, the display quality of an image is deteriorated as a whole.

Similarly, since also the potential differences between surface discharge electrodes 11 and data electrodes 14 are large, wall charge is sometimes written in error into data electrodes 14, and this deteriorates the image quality.

SUMMARY OF THE INVENTION

It is an object of the present invention to provide a plasma display panel which realizes at least one of reduction of magnetic noise, reduction of electric field noise, reduction of ground noise, simplification of the wiring line structure and augmentation of the quality of a display image.

A conventional plasma display panel to which the present invention is applied includes a plurality of surface discharge electrodes each including a scanning electrode and a sustain electrode and successively arranged in the column direction parallel to the row direction, a plurality of data electrodes successively arranged in the row direction parallel to the column direction and forming pixels at positions at which the data electrodes intersect with the surface discharge electrodes, and a discharge space positioned in the gap between the plane on which the plurality of data electrodes are arranged and the plane on which the plurality of surface discharge electrodes are arranged.

In a conventional plasma display panel such as the one described above, scanning pulses are successively applied to the plurality of scanning electrodes and data pulses corresponding to an image are successively applied to the plurality of data electrodes to write wall charge into the pixels corresponding to the image. Then, sustain pulses, whose feeding directions are reversed between a first condition and a second condition which occur alternately, are fed between the scanning electrodes and sustain electrodes to cause discharge to occur at the positions of the pixels in which the wall charge is written. By the discharge, a phosphor is caused to emit light to display the image.

In accordance with an aspect of the present invention in the plasma display panel as described above, when the surface discharge electrodes of a predetermined number of one or more rows arranged successively in the column direction are set as a set, positive and negative polarities of the sustain pulses are made opposite between the surface discharge electrodes of odd-numbered sets and even-numbered sets.

The plasma display panel of this aspect of the present invention can cancel and reduce electric field noises generated by feeding of sustain pulses of a high voltage.

In accordance with another aspect of the present invention, voltages whose positive and negative polarities are opposite to each other are applied to the scanning electrodes and sustain electrodes as the sustain pulses to be fed to the surface discharge electrodes.

In the plasma display panel of another aspect of the present invention, electric field noises generated by feeding of sustain pulses of a high voltage can cancel each other to reduce them, and the voltage to be fed to the grounding electrodes can be reduced to a very low voltage to reduce ground noise. Further, the potential differences of the scanning electrodes and sustain electrodes from the data electrodes can be reduced to augment the quality of an image to be displayed.

In accordance with still another aspect of the present invention, a ground potential is applied to all of the scanning electrodes, and when the surface discharge electrodes of a predetermined number of one or more rows arranged successively in the column direction are set as a set, voltages, whose positive and negative polarities are opposite between odd-numbered sets and even-numbered sets of the surface discharge electrodes, are applied as the sustain pulses to the sustain electrodes.

In the plasma display panel of this aspect of the present invention, electric field noises generated by feeding of sustain pulses of a high voltage can cancel each other to reduce them, and the voltage to be fed to the grounding electrodes can be reduced to a very low voltage to reduce ground noise. Further, the wiring line structures can be simplified to which allows increasing productivity and miniaturization.

In accordance with a still another aspect of the present invention, a ground potential is applied to all of the sustain electrodes, and when the surface discharge electrodes of a predetermined number of one or more rows arranged successively in the column direction are set as a set, voltages, whose positive and negative polarities are opposite between odd-numbered sets and even-numbered sets of the surface discharge electrodes, are applied as the sustain pulses to the scanning electrodes.

In the plasma display panel of the still further aspect of the present invention, electric field noises generated by feeding of sustain pulses of a high voltage can cancel each other to reduce them, and the voltage to be fed to the grounding electrodes can be reduced to a very low voltage to reduce ground noise. Further, the wiring line structures can be simplified to which allows increasing productivity and miniaturization.

In accordance with a yet another aspect of the present invention, when the surface discharge electrodes of a predetermined number of one or more rows arranged successively in the column direction are set as a set, a ground potential is applied alternately to the scanning electrodes and sustain electrodes in odd-numbered sets and even-numbered sets of the surface discharge electrodes, and voltages whose positive and negative polarities are opposite between odd-numbered sets and even-numbered sets of the surface discharge electrodes are applied as the sustain pulses to those of the scanning electrodes and sustain electrodes to which the ground potential is not applied.

In the plasma display panel of this aspect of the present invention, electric field noises generated by feeding of sustain pulses of a high voltage can cancel each other to reduce them, and the voltage to be fed to the grounding electrodes can be reduced to a very low voltage to reduce ground noise. Further, the wiring line structures can be simplified to which allows increasing productivity and miniaturization.

In the plasma display panel just described, when a pair of adjacent surface discharge electrodes of an odd-numbered set and an even-numbered set are set as a group, the positive and negative polarities of the voltages applied as the sustain pulses to each odd-numbered set of the surface discharge electrodes may be reversed alternately and the positive and negative polarities of the voltages applied as the sustain pulses to each even-numbered set of the surface discharge electrodes may be reversed alternately, between odd-numbered groups and even-numbered groups of the surface discharge electrodes.

In this instance, since the potential difference between a scanning electrode and a sustain electrode adjacent is each other on a boundary between an odd-numbered set and an even-numbered set of the surface discharge electrodes can be reduced, lighting of a pixel in error can be prevented, thereby increasing the quality of an image to be displayed.

In the plasma display panels described above, when a pair of adjacent surface discharge electrodes of an odd-numbered set and an even-numbered set are set as a group, wiring line structures for the scanning electrodes and sustain electrodes may be symmetrical in the row direction between odd-numbered groups and even-numbered groups of the surface discharge electrodes.

In this instance, since layout of the wiring lines and/or drivers for the scanning electrodes and sustain electrodes is facilitated, miniaturization can be realized and productivity of the apparatus can be increased.

In the plasma display panels described above, when the surface discharge electrodes of a predetermined number of one or more rows arranged successively in the column direction are set as a set, orders of the scanning electrodes and sustain electrodes may be alternately opposite to each other between odd-numbered sets and even-numbered sets of the surface discharge electrodes.

In this instance, since the potential difference between a scanning electrode and a sustain electrode adjacent is each other on a boundary between an odd-numbered set and an even-numbered set of the surface discharge electrodes can be reduced, lighting of a pixel in error can be prevented, thereby increasing the quality of an image to be displayed.

In the plasma display panels described above, voltages which serve as the sustain pulses may be applied to the scanning electrodes from the opposite ends of the same.

In this instance, since feeding routes of the sustain pulses can be distributed to the row direction with regard to the scanning electrodes, magnetic noise can be reduced.

In the plasma display panels described above, voltages which serve as the sustain pulses may be applied to the sustain electrodes from the opposite ends of the same.

In this instance, since feeding routes of the sustain pulses can be distributed to the row direction with regard to the sustain electrodes, magnetic noise can be reduced.

In the plasma display panels described above, when the surface discharge electrodes of a predetermined number of one or more rows arranged successively in the column direction are set as a set, feeding directions of the sustain pulses may be opposite to each other between the surface discharge electrodes of odd-numbered sets and even-numbered sets.

In this instance, magnetic noises generated by feeding of sustain pulses of a high voltage can cancel each other to reduce them.

In the plasma display panels described above, the polarities of voltages applied as the sustain pulses to adjacent scanning electrodes and sustain electrodes on boundaries between odd-numbered sets and even-numbered sets of the surface discharge electrodes may be of the same polarity.

In this instance, since the potential differences between the adjacent scanning electrodes and sustain electrodes on the boundaries between the odd-numbered sets and the even-numbered sets of the surface discharge electrodes are small, lighting of a pixel in error can be prevented, thereby increasing the quality of an image to be displayed.

In the plasma display panels described above, the polarities of voltages applied as the sustain pulses to adjacent scanning electrodes on boundaries between odd-numbered sets and even-numbered sets of the surface discharge electrodes may be of the same polarity.

In this instance, since the potential differences between the adjacent scanning electrodes on the boundaries between the odd-numbered sets and the even-numbered sets of the surface discharge electrodes are small, lighting of a pixel in error can be prevented, thereby increasing the quality of an image to be displayed.

In the plasma display panels described above, the polarities of voltages applied as the sustain pulses to adjacent sustain electrodes on boundaries between odd-numbered sets and even-numbered sets of the surface discharge electrodes may be of the same polarity.

In this instance, since the potential differences between the adjacent scanning electrodes on the boundaries between the odd-numbered sets and the even-numbered sets of the surface discharge electrodes are small, lighting of a pixel in error can be prevented, thereby increasing the quality of an image to be displayed. Besides, since the potential differences between the adjacent sustain electrodes on the boundaries between the odd-numbered sets and the even-numbered sets of the surface discharge electrodes are small, lighting of a pixel in error can be prevented, thereby increasing the quality of an image to be displayed.

The above and other objects, features and advantages of the present invention will become apparent from the following description with reference to the accompanying drawings which illustrate examples of the present invention.

DETAILED DESCRIPTION OF THE PREFERRED EMBODIMENTS

A first embodiment of the present invention is described with reference to FIGS. 4 and 5. It is to be noted that same elements of the present embodiment as those of the conventional example described hereinabove are referred to by same names and detailed description of them is omitted here.

Further, in the present embodiment, the upward, downward and leftward, rightward directions of the apparatus are used corresponding to those of the drawings. However, such directions are used for convenience in order to simplify the description and do not restrict the directions of an actual apparatus upon production or use.

Figure 1:
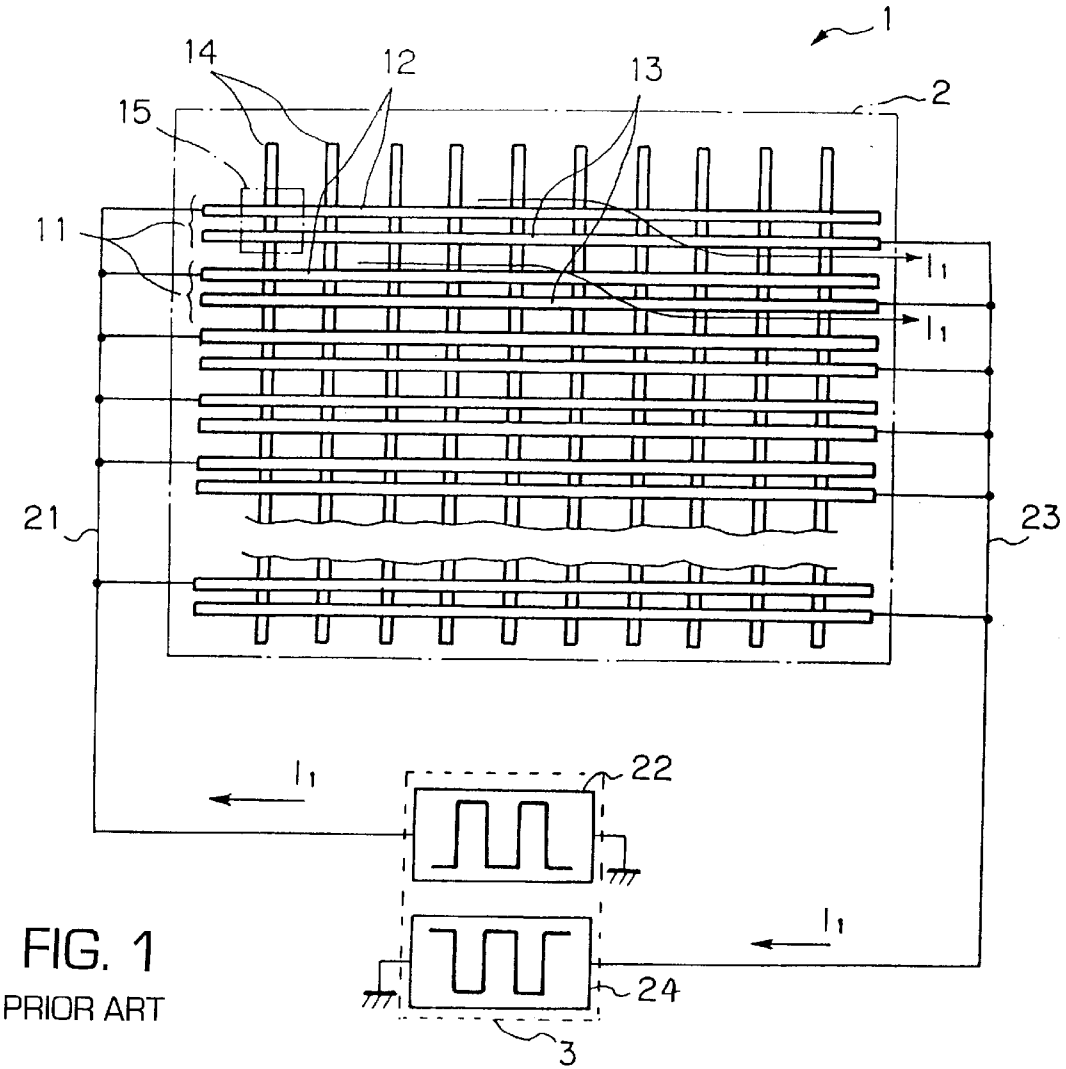
FIG. 1 PRIOR ART
FIG. 1 is a schematic view showing a plasma display panel of a conventional example.
Figure 2:
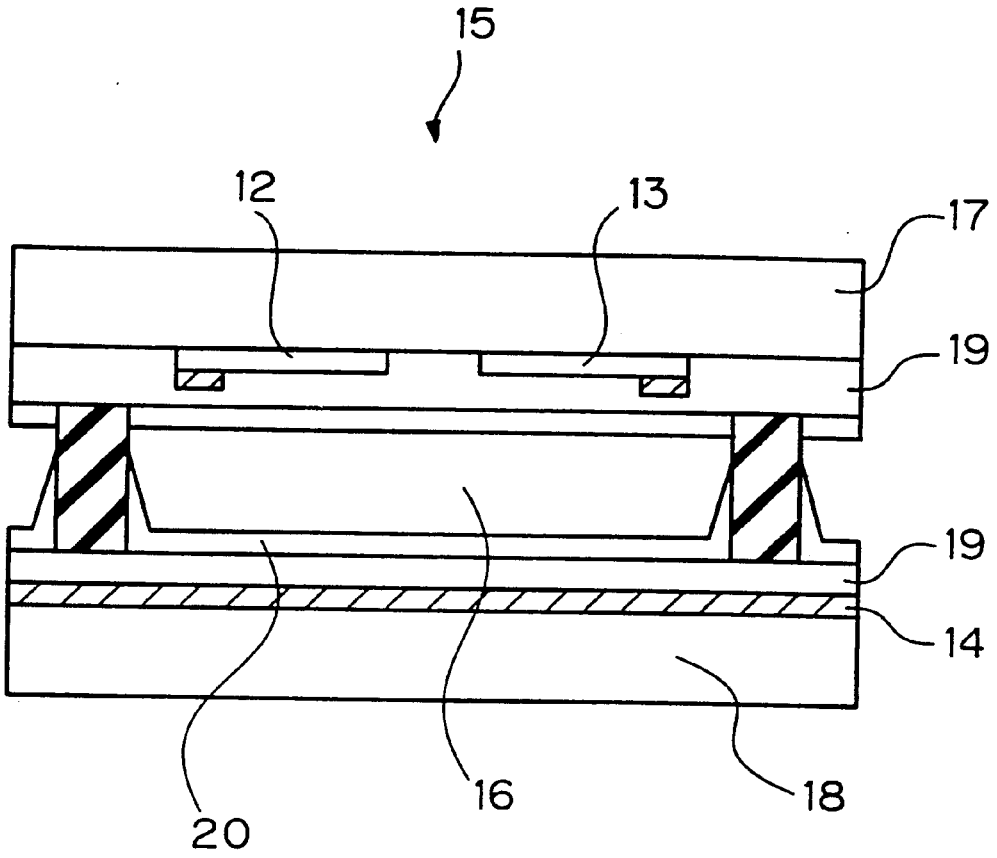
FIG. 2 PRIOR ART
FIG. 2 is a cross sectional plan view showing a layer structure of a display panel.
Figure 3:
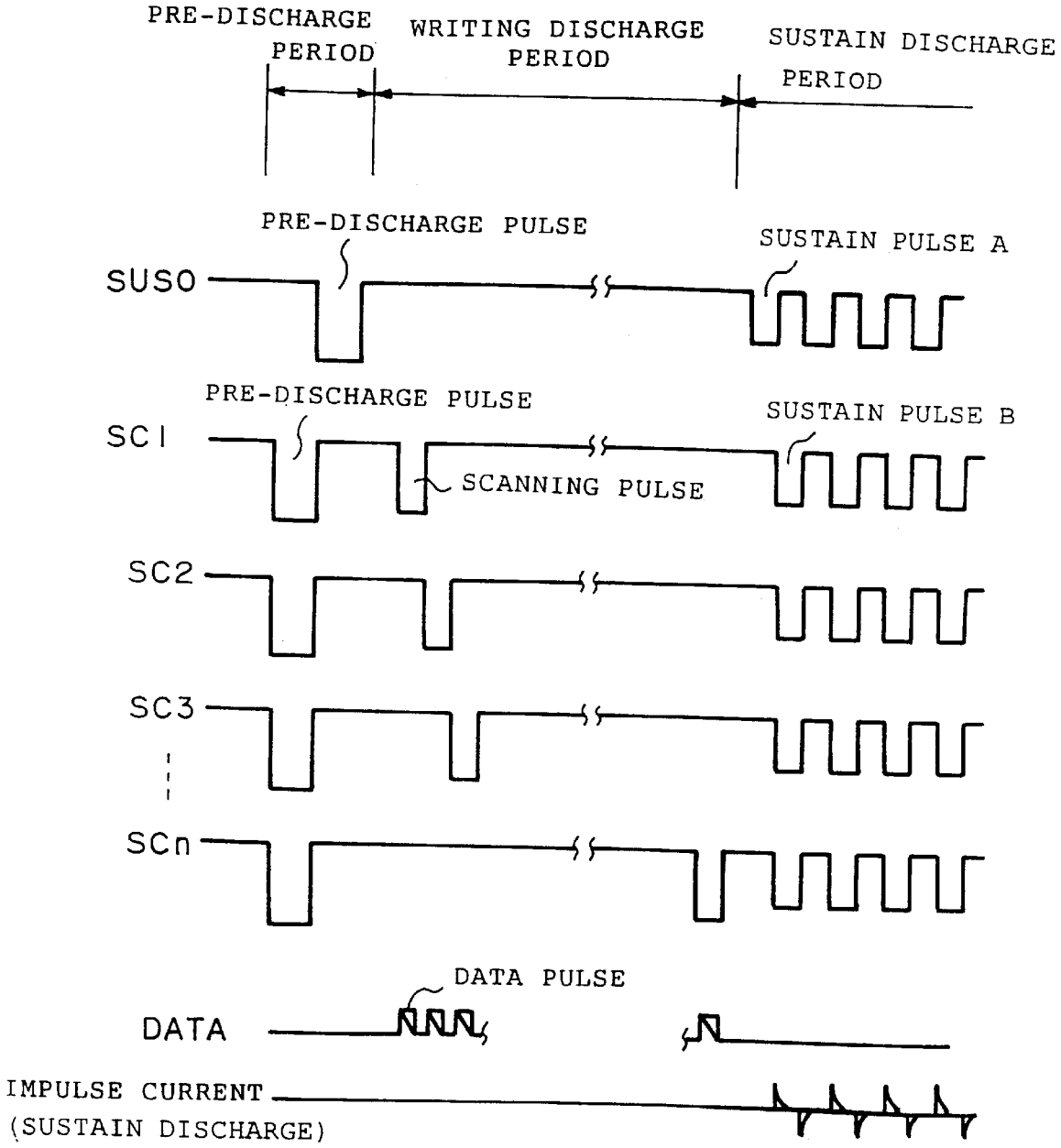
FIG. 3 PRIOR ART
FIG. 3 is a time chart illustrating a driving method for the plasma display panel.
Figure 4:
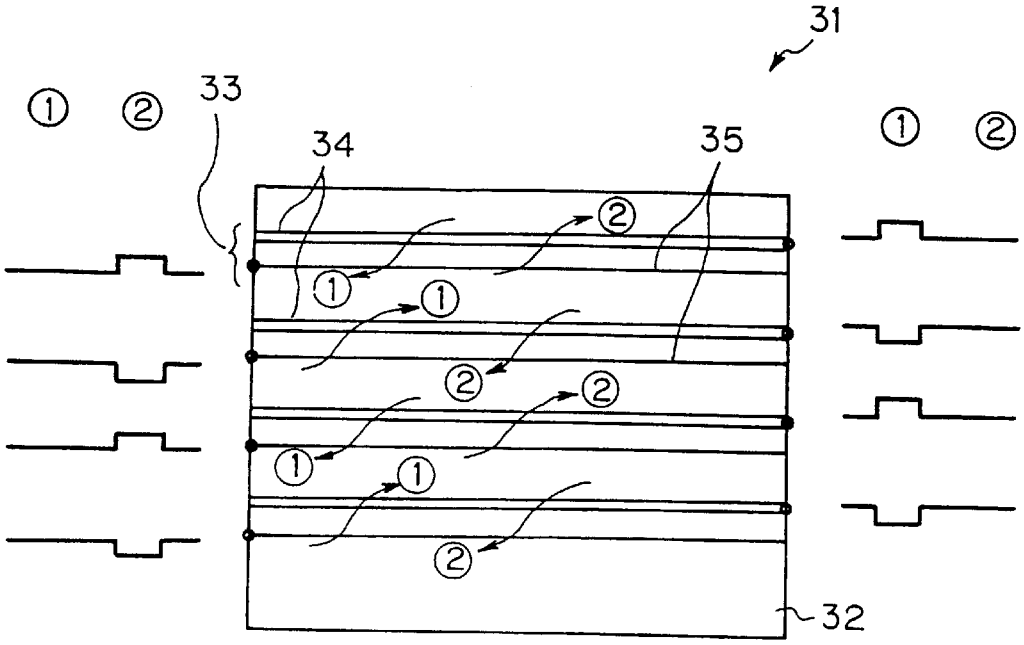
FIG. 4 is a schematic view showing a plasma display panel of a first embodiment of the present invention.

Here, in order to simplify the description, the leftward and rightward direction of FIG. 4 is referred to as the row direction and the upward and downward direction is referred to as the column direction. The row direction is a direction parallel to the rows, and a plurality of columns are successively arranged in the row direction. The column direction is the direction parallel to the columns, and a plurality of rows are successively arranged in the column direction.

Plasma display panel 31 of the surface discharge type of the AC type of the present embodiment includes, as shown in FIG. 4, display panel 32 on which a large number of surface discharge electrodes 33 parallel to the row direction are successively arranged in the column direction similarly as in plasma display panel 1 described hereinabove as the conventional example. Each of the surface discharge electrodes 33 is composed of scanning electrode 34 and sustain electrode 35 arranged at upper and lower locations, respectively.

On the rear sides of surface discharge electrodes 33, a large number of data electrodes parallel to the column direction are successively arranged in the row direction with a discharge space interposed therebetween in which gas of a phosphor is enclosed. A large number of data drivers are individually connected to the large number of data electrodes (not shown).

It is to be noted here that, for simplified illustration, connection terminals of display panel 32 to which various drivers are connected are represented as black points.

Figure 5A:
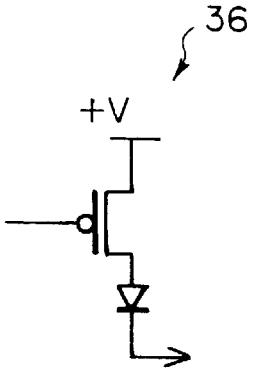
FIG. 5*a* is a circuit diagram showing a scanning driver.
Figure 5B:
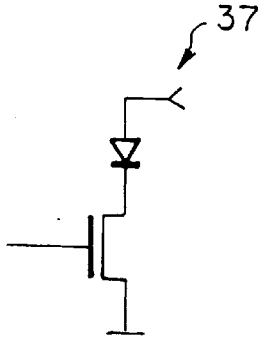
FIG. 5*b* is a circuit diagram showing a sustain driver.

Further, a large number of scanning drivers are individually connected to the right ends, which are shown on the right side in FIG. 4, of the large number of scanning electrodes 34 by a large number of scanning wiring lines. However, different from plasma display panel 1 described hereinabove as the conventional example, as shown in FIGS. 5*a* and 5*b*, the scanning driver for each odd-numbered row which is an odd-numbered set of surface discharge electrodes 33 is formed from positive driver 36 which generates a positive sustain pulse, but the scanning driver for each even-numbered row which is an even-numbered set of surface discharge electrodes 33 is formed from negative driver 37 which generates a negative sustain pulse.

Further, a sustain driver is connected to the left end, which is shown on the left side in FIG. 4, of each of the large number of sustain electrodes 35 by a sustain wiring line. However, such sustain wiring lines and sustain drivers are formed in two systems for odd-numbered rows, which correspond to odd-numbered sets of surface discharge electrodes 33, and even-numbered rows, which correspond to even-numbered sets of surface discharge electrodes 33.

In particular, each of the sustain drivers for odd-numbered rows of surface discharge electrodes 33 is composed of positive driver 36 which generates a positive sustain pulse, but each of the sustain drivers for even-numbered rows of surface discharge electrodes 33 is composed of negative driver 37 which generates a negative sustain pulse.

In plasma display panel 31 of the present embodiment, operation is set such that, in the first condition (① of FIG. 4), only the scanning drivers generate sustain pulses while the sustain drivers are at rest, but in the second condition (② of FIG. 4), the scanning drivers are at rest while only the sustain drivers generate sustain pulses.

Also plasma display panel 31 of the surface discharge type of the AC type of the present embodiment having such a construction as described above can display a desired image in a dot matrix system by individually controlling the large number of pixels arranged in a column so that they may or may not emit light similarly as in plasma display panel 1 described hereinabove as the conventional example.

Also in this instance, after wall charge is written into the positions of those pixels which correspond to the image, sustain pulses are applied to all of the large number of scanning electrodes 34 and all of the large number of sustain electrodes 35.

In this instance, also in plasma display panel 31 of the present embodiment, as seen in FIG. 4, sustain pulses applied to scanning electrodes 34 and sustain pulses applied to sustain electrodes 35 are reversed in generation timing. However, the sustain pulses are opposite between the positive and negative polarities in odd-numbered ones and even-numbered ones of surface discharge electrodes 33.

Therefore, in the first condition ①, positive sustain pulses are fed from scanning electrodes 34 to sustain electrodes 35 in the surface discharge electrodes 33 in the odd-numbered rows, but negative sustain pulses are fed from sustain electrodes 35 to scanning electrodes 34 in the surface discharge electrodes 33 in the even-numbered rows.

Similarly, in the second condition ②, positive sustain pulses are fed from sustain electrodes 35 to scanning electrodes 34 in the surface discharge electrodes 33 in the odd-numbered rows, but negative sustain pulse are fed from scanning electrodes 34 to sustain electrodes 35 in surface discharge electrodes 33 in the even-numbered rows.

In short, in plasma display panel 31 of the present embodiment, the feeding directions of sustain pulses through surface charge electrodes in the odd-numbered rows and the even-numbered rows are opposite to each other in both of the first and second conditions ① and ② as described above. Consequently, magnetic noises which are generated by feeding of sustain pulses of a high voltage cancel each other.

Besides, since the positive and negative polarities of sustain pulses for surface discharge electrodes 33 of the odd-numbered row and the even-numbered rows are reversed to each other in both of the first and second conditions ① and ②, also electric field noises generated by feeding of sustain pulses of a high voltage can cancel each other.

Plasma display panel 31 of the present embodiment can prevent magnetic noises and electric field noises from having a bad influence on an electric product since these noises individually cancel each other as described above.

In other words, since sustain pulses of a sufficiently high voltage can be applied to surface discharge electrodes 33, an image can be displayed with a high brightness.

Further, since omission of an EMI (Electro-Magnetic Interface) filter for suppressing passage of electromagnetic wave noises generated from display panel 32 and use of an EMI filter which is small in thickness and has a high transmission factor for visible rays are possible, the brightness of an image can be augmented also from this point of view, and it is also possible to simplify the structure and raise the productivity.

It is to be noted that the present invention is not limited to the embodiment described above, but allows various modifications without departing from the spirit or scope of the present invention.

For example, it is described in the foregoing description of the embodiment that positive sustain pulses are applied to the surface discharge electrodes 33 in the odd-numbered rows and negative sustain pulses are applied to the surface discharge electrodes 33 in the even-numbered rows. However, it is naturally possible to reverse the positive and negative polarities of sustain pulses described above.

Further, it is described in the foregoing description of the embodiment that, when surface discharge electrodes 33 of one row are set as one set, the feeding directions and the positive and negative polarities of sustain pulses are made reverse to each other between odd-numbered rows which are odd-numbered sets of surface discharge electrodes 33 and even-numbered rows which are even-numbered sets of surface discharge electrodes 33.

However, it is otherwise possible to set the surface discharge electrodes 33 in a predetermined number of rows of more than one row successively arranged in the column direction as a set and make the feeding directions and the positive and negative polarities of sustain pulses reverse to each other between surface discharge electrodes 33 of the odd-numbered sets and the even-numbered sets.

In this instance, magnetic noises or electric field noises cancel each other in units of a plurality of rows of surface discharge electrodes 33, and when compared with the embodiment described above, the wiring line structures and so forth can be simplified.

However, where a plurality of rows of surface discharge electrodes 33 are set as a unit as described above, the effect of noise reduction may possibly be deteriorated. This, however, does not matter because surface discharge electrodes 33 are arranged in a sufficiently high density in the column direction.

Now, a second embodiment of the present embodiment is described with reference to FIGS. 6 to 8. It is to be noted that same elements of the present second embodiment as those of the first embodiment described above are referred to by same names and same reference numerals, and detailed description of them is omitted here.

Also in plasma display panel 41 of the present embodiment, a large number of scanning drivers 42 are individually connected to the right ends of a large number of scanning electrodes 34. However, scanning drivers 42 are formed in such a structure that voltages whose positive and negative polarities are reversed alternately are generated as sustain pulses as seen in FIG. 7.

Figure 8:
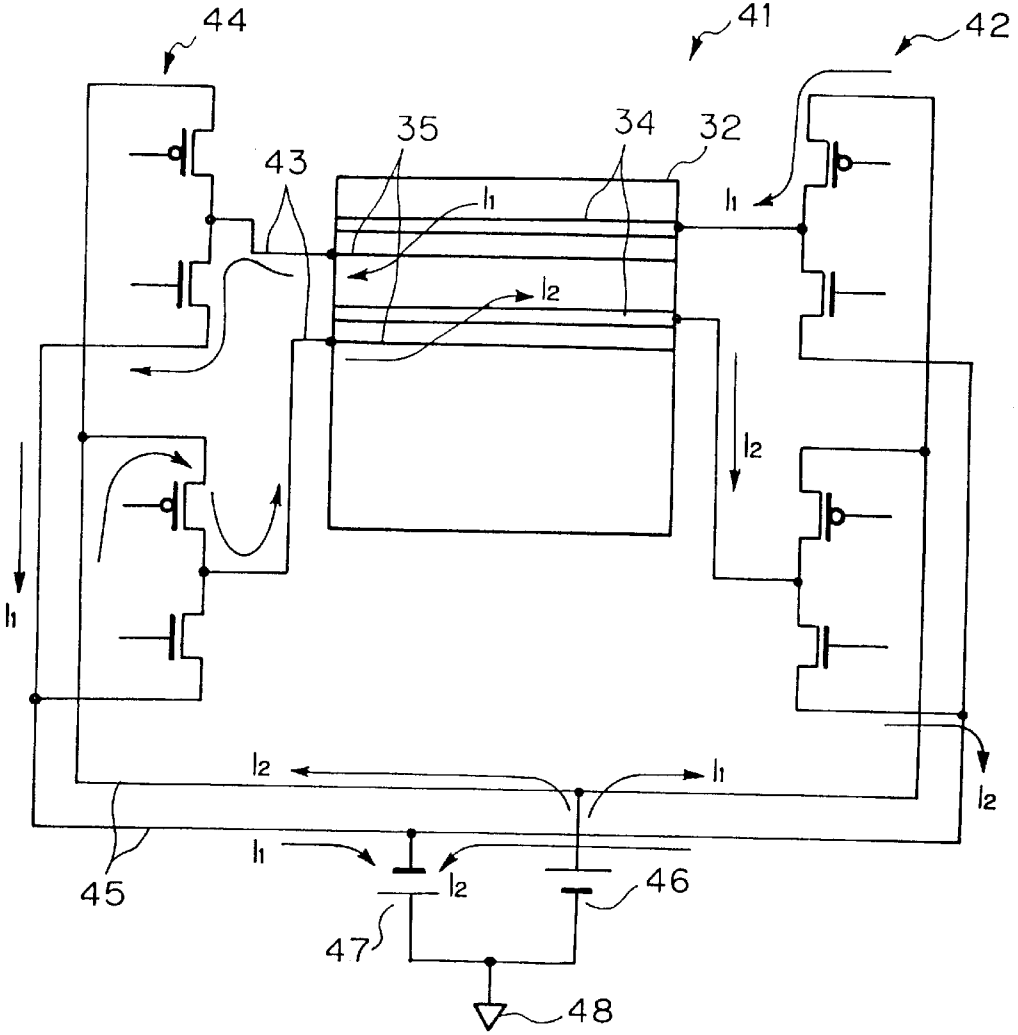
FIG. 8 is a schematic view showing connection structures of several parts.

Further, to the left end of each of the large number of sustain electrodes 35, sustain driver 44 is connected by sustain wiring line 43 as seen in FIG. 8. However, sustain wiring lines 43 and sustain drivers 44 are formed in two different systems between odd-numbered rows which are odd-numbered sets of surface discharge electrodes 33 and even-numbered rows which are even-numbered sets of surface discharge electrodes 33. Also sustain drivers 44 are formed in such a structure that voltages whose positive and negative polarities are reversed alternately are generated as sustain pulses similarly to scanning drivers 42.

To scanning drivers 42 and sustain drivers 44, positive and negative power supply circuits 46, 47 are connected by power supply wiring lines 45. Grounding electrode 48 is connected to power supply circuits 46, 47 so that a grounding voltage is applied to them.

In plasma display panel 41 of the present embodiment, when sustain pulses whose directions are reversed between the first condition ① and the second condition ② are supplied to surface discharge electrodes 33, voltages whose positive and negative polarities are opposite to each other are applied to scanning electrodes 34 and sustain electrodes 35 by scanning drivers 42 and sustain drivers 44.

Further, in plasma display panel 41 of the present embodiment, between those of surface discharge electrodes 33 in the odd-numbered rows which are odd-numbered sets and the even-numbered rows which are even-numbered sets, the positive and negative polarities of voltages applied as sustain pulses to sustain electrodes 35 are opposite to each other and also the positive and negative polarities of voltages applied as sustain pulses to positive driver 36 are opposite to each other.

In particular, in the first condition ①, positive sustain pulses are applied to scanning electrodes 34 of the surface 'discharge electrodes 33 in the odd-numbered rows which are odd-numbered sets and sustain electrodes 35 of the surface discharge electrodes 33 in the even-numbered rows which are even-numbered sets, and negative sustain pulses are applied to scanning electrodes 34 of the surface discharge electrodes 33 in the even-numbered rows and sustain electrodes 35 of the surface discharge electrodes 33 in the odd-numbered rows.

On the other hand, in the second condition ②, negative sustain pulses are applied to scanning electrodes 34 of the surface discharge electrodes 33 in the odd-numbered rows and sustain electrodes 35 of the surface discharge electrodes 33 in the even-numbered rows, and positive sustain pulses are applied to scanning electrodes 34 of the surface discharge electrodes 33 in the even-numbered rows and sustain electrodes 35 of the surface discharge electrodes 33 in the odd-numbered rows.

Figure 6:
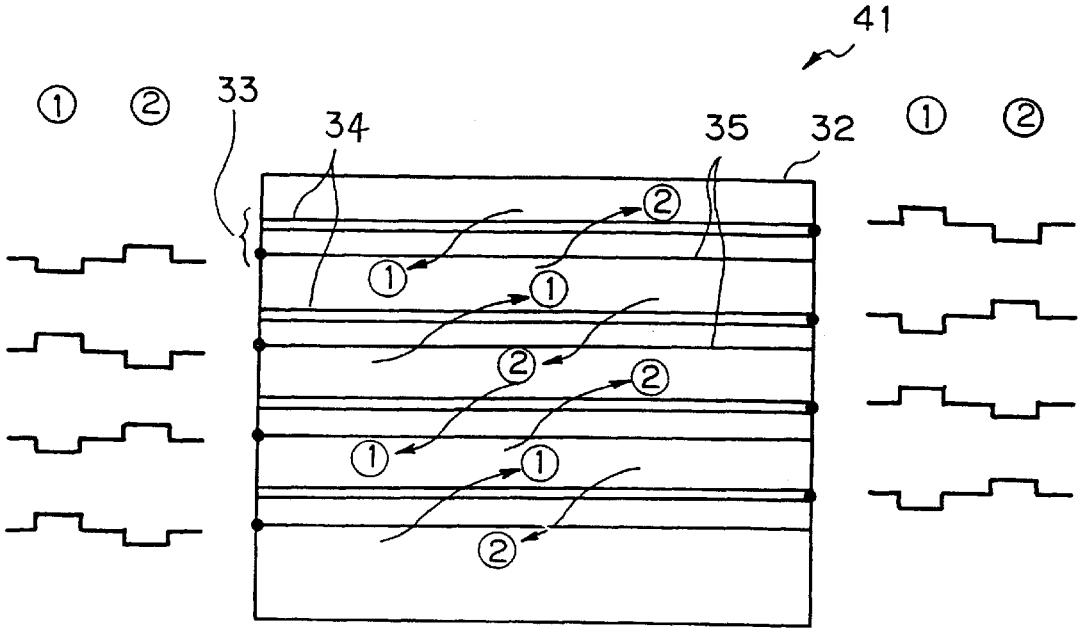
FIG. 6 is a schematic view showing a plasma display panel of a second embodiment of the present invention.
Figure 7:
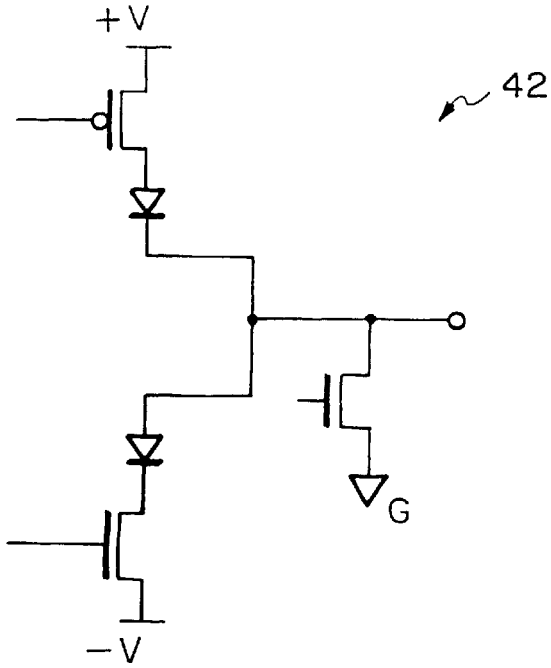
FIG. 7 is a circuit diagram showing a scanning driver.

Also in plasma display panel 41 of the present second embodiment having such a construction as described above, similarly to plasma display panel 31 described hereinabove as the first embodiment, in the first condition ①, sustain pulses are fed from scanning electrodes 34 to sustain electrodes 35 in the surface discharge electrodes 33 in the odd-numbered rows, but in the surface discharge electrodes 33 in the even-numbered rows, sustain pulses are supplied from sustain electrodes 35 to scanning electrodes 34 as seen in FIG. 6.

However, sustain pulses fed in this manner are formed from voltages of both of the positive and negative polarities.

Therefore, in plasma display panel 41 of the present embodiment, since the feeding directions of the sustain pulses to both of surface discharge electrodes 33 of the odd-numbered rows and the even-numbered rows are opposite to each other in both of the first and second conditions ① and ② as described above, magnetic noises generated by feeding of sustain pulses of a high voltage cancel each other.

Besides, since the sustain pulses are applied as voltages of both of the positive and negative polarities to scanning electrodes 34 and sustain electrodes 35, even if sustain pulses of a high voltage are fed, generation of electric field noises is prevented.

Furthermore, since the sustain pulses are formed from voltages of both of the positive and negative polarities of both of electrodes 34, 35 as described above, the voltage fed to grounding electrode 48 is very low. Accordingly, also ground noise is reduced.

More particularly, as seen in FIG. 8, in the first condition ①, current $I_1$ of a sustain pulse for an odd-numbered row is fed from positive power supply circuit 46 back to negative power supply circuit 47 successively passing through a positive pole driver of scanning drivers 42 in the odd-numbered row on the right side in FIG. 8, scanning electrode 34 of the odd-numbered row, sustain electrode 35 of the odd-numbered row, and a negative pole driver of sustain drivers 44 of the odd-numbered row on the left side of FIG. 8.

Simultaneously, current $I_2$ of a sustain pulse for an even-numbered row is fed from positive power supply circuit 46 back to negative power supply circuit 47 successively passing through a positive pole driver of sustain drivers 44 in the even-numbered row on the left side in FIG. 8, sustain electrode 35, scanning electrode 34, and a negative pole driver of scanning drivers 42 of the even-numbered row on the right side of FIG. 8.

Since currents $I_1$ and $I_2$ are opposite in feeding direction to each other and do not flow to the other ground electrode, plasma display panel 41 of the present embodiment exhibits a very small potential variation of grounding electrode 48 and is reduced in ground noise.

Further, in plasma display panel 41 of the present embodiment, sustain electrodes 35 of that one of surface discharge electrodes 33 in each odd-numbered row and scanning electrode 34 of that one of surface discharge electrodes 33 in each even-numbered row are positioned adjacent to each other. However, the voltages applied to them are same in polarity between the positive and negative polarities in any condition.

Similarly, also sustain electrode 35 of that one of surface discharge electrodes 33 in each even-numbered row and scanning electrode 34 of that one of surface discharge electrodes 33 in each odd-numbered row are positioned adjacent to each other. However, also the voltages applied to them are same in polarity between the positive and negative polarities in any condition.

In short, since the potential difference between adjacent surface discharge electrodes 33 is small, wall charge is not written in error into the position of any pixel which is not to be lit. Consequently, since an unnecessary pixel is not lit at all by application of a sustain pulse, an image can be displayed with a good quality.

Further, since the voltages of the sustain pulses are distributed to the positive and negative polarities, the voltages to be applied to scanning electrodes 34 and sustain electrodes 35 can be reduced to one half those in the conventional example.

Consequently, since also the potential differences between electrodes 34, 35 and the data electrodes are small, wall charge is not written in error to the position of any pixel which is not to be lit, and an image can be displayed with a good quality.

Besides, since the voltages to be applied to electrodes 34, 35 may be one half those of the conventional example, also the capacity of the power supply circuit can be reduced.

Generally since, comparing with one power supply circuit of a high voltage, two power supply circuits of one half voltage can be produced readily and at a low cost, plasma display panel 41 of the present embodiment is good in productivity and can be produced at a reduced cost.

In the following, a third embodiment of the present invention is described with reference to FIGS. 9 and 10. It is to be noted that same elements of the present third embodiment as those of the second embodiment described above are referred to by same names and same reference numerals, and detailed description of them is omitted here.

Figure 9:
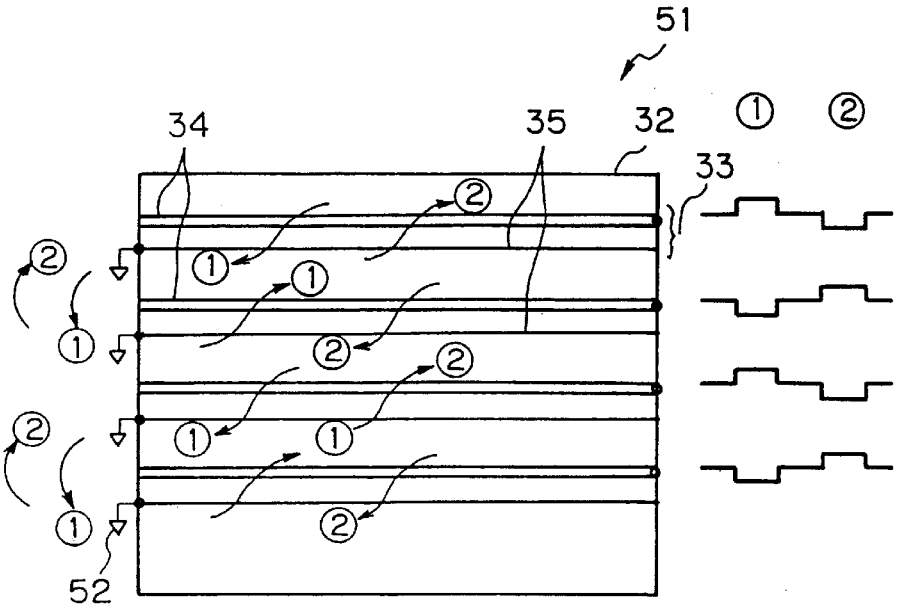
FIG. 9 is a schematic view showing a plasma display panel of a third embodiment of the present invention.

In plasma display panel 51 of the present embodiment, as shown in FIG. 9, a large number of scanning drivers 42 which individually generate sustain pulses whose positive and negative polarities are alternately reversed are connected to the right ends of a large number of scanning electrodes 34. However, to the left ends of the large number of sustain electrodes 35, grounding electrodes 52 are connected in place of sustain drivers 44.

Figure 10:
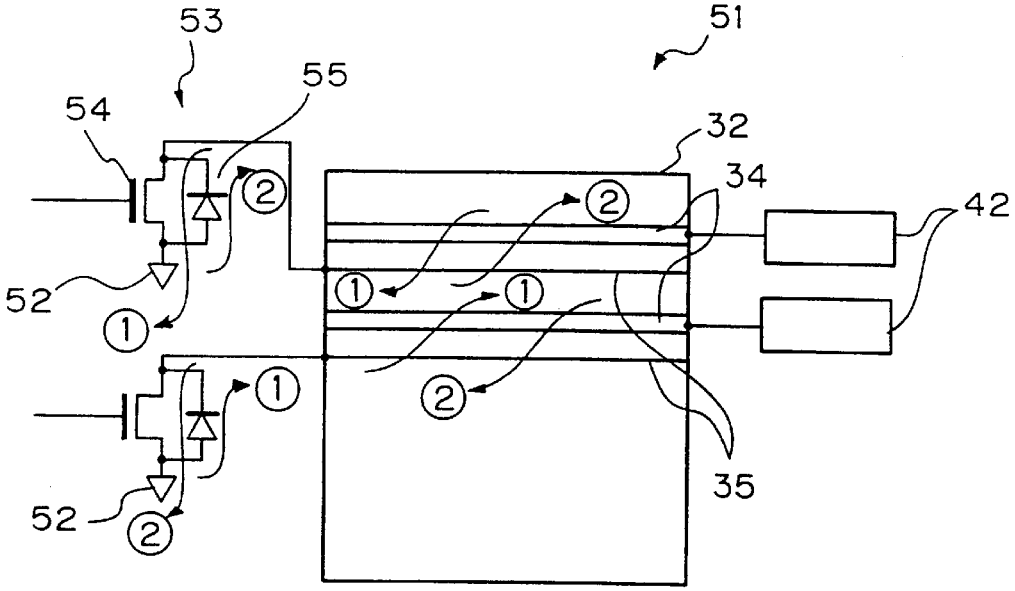
FIG. 10 is a schematic view showing connection structures of several parts.

More particularly, as shown in FIG. 10, actually ground drivers 53 are connected to the left ends of sustain electrodes 35, and ground drivers 53 are connected to grounding electrodes 52.

Each of ground drivers 53 is composed of n-type MOS (Metal Oxide Semiconductor) transistor 54 and parasitic diode 55, and applies the ground potential to the left end of a corresponding one of sustain electrodes 35.

Further, in plasma display panel 51 of the present embodiment, when sustain pulses whose directions are reversed between the first condition ① and the second condition ② are fed to surface discharge electrodes 33, voltages whose positive and negative polarities are opposite to each other between those surface discharge electrodes 33 in odd-numbered rows which are odd-numbered sets and those of surface discharge electrodes 33 in even-numbered rows which are even-numbered sets are applied to scanning electrodes 34 by scanning drivers 42.

In particular, in the first condition ①, positive sustain pulses are applied to scanning electrodes 34 of the surface discharge electrodes 33 in the odd-numbered rows, and negative sustain pulses are applied to scanning electrodes 34 of the surface discharge electrodes 33 in the odd-numbered rows. In the second condition ②, negative sustain pulses are applied to scanning electrodes 34 of the surface discharge electrodes 33 in the odd-numbered rows, and positive sustain pulses are applied to scanning electrodes 34 of the surface discharge electrodes 33 in the even-numbered rows.

In plasma display panel 51 of the present third embodiment having such a construction as described above, in the first condition ①, positive sustain pulses are fed from scanning electrodes 34 to sustain electrodes 35 in the surface discharge electrodes 33 in the odd-numbered rows while negative sustain pulses are supplied from sustain electrodes 35 to scanning electrodes 34 in the surface discharge electrodes 33 in the even-numbered rows.

More particularly, the sustain pulses for the odd-numbered rows in the first condition ① are fed from scanning drivers 42 for the odd-numbered rows back to grounding electrodes 52 successively passing through scanning electrodes 34 of the odd-numbered rows, sustain electrodes 35 of the odd-numbered rows, and MOS transistor 54 of ground drivers 53 of the odd-numbered rows.

Simultaneously, the sustain pulses for the even-numbered rows in the first condition ① are fed from grounding electrodes 52 to scanning drivers 42 successively passing through parasitic diodes 55 of ground drivers 53 of the even-numbered rows, sustain electrodes 35, and scanning electrodes 34.

Similarly, in the second condition ②, negative sustain pulses are fed from sustain electrodes 35 to scanning electrodes 34 of surface discharge electrodes 33 of the odd-numbered rows, but positive sustain pulses are fed from scanning electrodes 34 to sustain electrodes 35 of surface discharge electrodes 33 of the even-numbered rows.

Consequently, in plasma display panel 51 of the present embodiment, since the feeding directions of sustain pulses in surface discharge electrodes 33 in the odd-numbered rows and the even-numbered rows are opposite to each other in both of the first and second conditions ① and ② as described above, magnetic noises generated by feeding of sustain pulses of high voltages cancel each other.

Besides, since the positive and negative polarities of sustain pulses of surface discharge electrodes 33 in the odd-numbered rows and the even-numbered rows are opposite to each other in both of the first and second conditions ① and ②, also electric field noises generated by feeding of sustain pulses of high voltages cancel each other.

Furthermore, since the positive and negative polarities of sustain pulses applied to scanning electrodes 34 of two adjacent surface discharge electrodes 33 are opposite to each other between, voltages whose positive and negative polarities are opposite to each other are applied to grounding electrodes 52 of adjacent surface discharge electrodes 33.

Consequently, voltages of positive and negative sustain pulses applied from scanning electrodes 34 to sustain electrodes 35 of surface discharge electrodes 33 are fed to sustain electrodes 35 of adjacent surface discharge electrodes 33, and since the voltage discharged to grounding electrodes 52 is very low, also ground noise is reduced.

It is to be noted that the present invention is not limited to the embodiments described above, and various modifications can be made thereto without departing from the scope or spirit thereof.

For example, it is described in the above described embodiment that scanning drivers 42 are connected only to scanning electrodes 34 while sustain electrodes 35 are connected to grounding electrodes 52. However, also it is possible to connect only sustain electrodes 35 to sustain drivers 44 while scanning electrodes 34 are connected to grounding electrodes 52.

Figure 11:
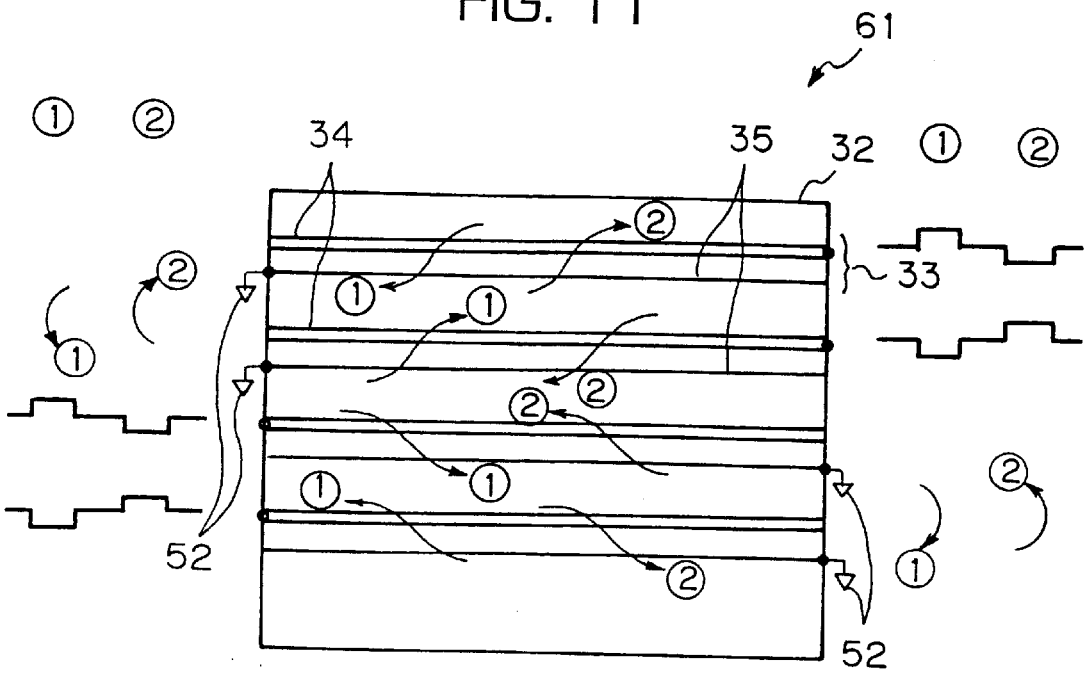
FIG. 11 is a schematic view showing a plasma display panel of a fourth embodiment of the present invention.

In the following, a fourth embodiment of the present invention is described with reference to FIG. 11. It is to be noted that same elements of the present fourth embodiment as those of the third embodiment described above are referred to by same names and reference numerals, and detailed description of them is omitted here.

In plasma display panel 61 of the present embodiment, similarly as in plasma display panel 51 described hereinabove as the third embodiment, a large number of scanning drivers 42 are individually connected to a large number of scanning electrodes 34, and grounding electrodes 52 are connected to the large number of sustain electrodes 35 via ground drivers 53.

However, different from plasma display panel 51 described hereinabove, in plasma display panel 61 of the present embodiment, where a group is formed from a pair of adjacent surface discharge electrodes 33 in an odd-numbered row which is an odd-numbered set and an even-numbered row which is an even-numbered set, the wiring line structures for scanning electrodes 34 and sustain electrodes 35 are symmetrical in the leftward and rightward direction, which is the row direction, between odd-numbered groups and even-numbered groups.

In particular, in surface discharge electrodes 33 of the (4a+1)th rows (a is an integer larger than 0) and the (4a+2)th rows, scanning drivers 42 are connected the right ends of scanning electrodes 34 while grounding electrodes 52 are connected to the left ends of sustain electrodes 35 through ground drivers 53.

In surface discharge electrodes 33 of the (4a+3)th rows and the (4a+4)th rows, scanning drivers 42 are connected to the left ends of scanning electrodes 34 while grounding electrodes 52 are connected to the right ends of sustain electrodes 35 through ground drivers 53.

In plasma display panel 61 of the present fourth embodiment having such a construction as described above, since the feeding directions of sustain pulses through surface discharge electrodes 33 of the odd-numbered rows and the even-numbered rows are opposite to each other in both of the first and second conditions ① and ② similarly as in plasma display panel 51 described hereinabove as the third embodiment, magnetic noises cancel each other. Further, since the positive and negative polarities of sustain pulses of surface discharge electrodes 33 in the odd-numbered rows and the even-numbered rows are opposite to each other, also electric field noises cancel each other.

Besides, since the positive and negative polarities of sustain pulses applied to scanning electrodes 34 of adjacent surface discharge electrodes 33 are opposite to each other, the voltage discharged to grounding electrodes 52 is very low and also ground noise is reduced.

Furthermore, since, where a group is formed from a pair of adjacent surface discharge electrodes 33 in an odd-numbered row and an even-numbered row, the wiring line structures for surface discharge electrodes 33 are symmetrical in the leftward and rightward direction between an odd-numbered group and an even-numbered group, the connections between scanning electrodes 34 and scanning drivers 42 can be distributed to the left and right for each two rows.

Consequently, formation of the scanning wiring lines and arrangement of scanning drivers 42 are easy. Further, it is possible to miniaturize plasma display panel 61 and increase its productivity.

Figure 12:
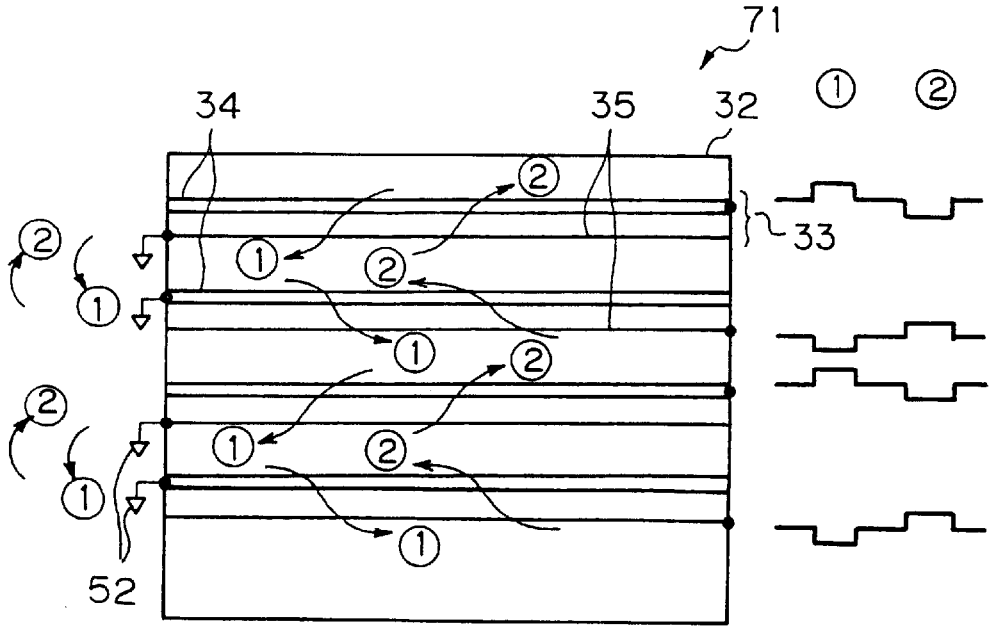
FIG. 12 is a schematic view showing a plasma display panel of a fifth embodiment of the present invention.

In the following, a fifth embodiment of the present invention is described with reference to FIG. 12. It is to be noted that same elements of the present fifth embodiment as those of the third embodiment described above are referred to by same names and reference numerals, and detailed description of them is omitted here.

In plasma display panel 71 of the present embodiment, scanning electrodes 34 and sustain electrodes 35 are connected alternately to grounding electrodes 52 in odd-numbered rows of surface discharge electrodes 33 which are odd-numbered sets and even-numbered rows of surface discharge electrodes 33 which are even-numbered sets.

To the scanning electrodes 34 and sustain electrodes 35 which are not connected to grounding electrodes 52, scanning drivers 42 and sustain drivers 44 which generate sustain pulses whose positive and negative polarities are reversed alternately are connected.

Thus, in plasma display panel 71 of the present embodiment, when sustain pulses whose directions are reversed between the first condition ① and the second condition ② are fed to surface discharge electrodes 33, voltages whose positive and negative polarities are opposite to each other between surface discharge electrodes 33 of the odd-numbered rows and the even-numbered rows are applied to electrodes 34, 35 to which the ground potential is not applied.

In particular, in the first condition ①, positive sustain pulses are applied to the scanning electrodes 34 of surface discharge electrodes 33 of the odd-numbered rows while negative sustain pulses are applied to sustain electrodes 35 of surface discharge electrodes 33 of the even-numbered rows.

In the second condition ②, negative sustain pulses are applied to scanning electrodes 34 of surface discharge electrodes 33 of the odd-numbered rows while positive sustain pulses are applied to sustain electrodes 35 of surface discharge electrodes 33 of the even-numbered rows.

In plasma display panel 71 of the present fifth embodiment having such a construction as described above, in the first condition ①, positive sustain pulses are fed from scanning electrodes 34 to sustain electrodes 35 in surface discharge electrodes 33 of the odd-numbered rows, and negative sustain pulses are fed from scanning electrodes 34 to sustain electrodes 35 in surface discharge electrodes 33 of the even-numbered rows.

On the other hand, in the second condition ②, negative sustain pulses are fed from sustain electrodes 35 to scanning electrodes 34 in surface discharge electrodes 33 of the even-numbered rows, and positive sustain pulses are fed from sustain electrodes 35 to scanning electrodes 34 in surface discharge electrodes 33 of the even-numbered rows.

Consequently, in plasma display panel 71 of the present embodiment, since the feeding directions of sustain pulses through surface discharge electrodes 33 of the odd-numbered rows and the even-numbered rows are opposite to each other in both of the first and second conditions ① and ② as described above, magnetic noises cancel each other. Further, since the positive and negative polarities of sustain pulses of surface discharge electrodes 33 of the odd-numbered rows and the even-numbered rows are opposite to each other, also electric field noises cancel each other.

Furthermore, since the positive and negative polarities of sustain pulses applied to electrodes 34, 35 are opposite to each other between adjacent surface discharge electrodes 33, the voltage discharged to grounding electrodes 52 is very low, and also the ground noise is reduced.

Figure 13:
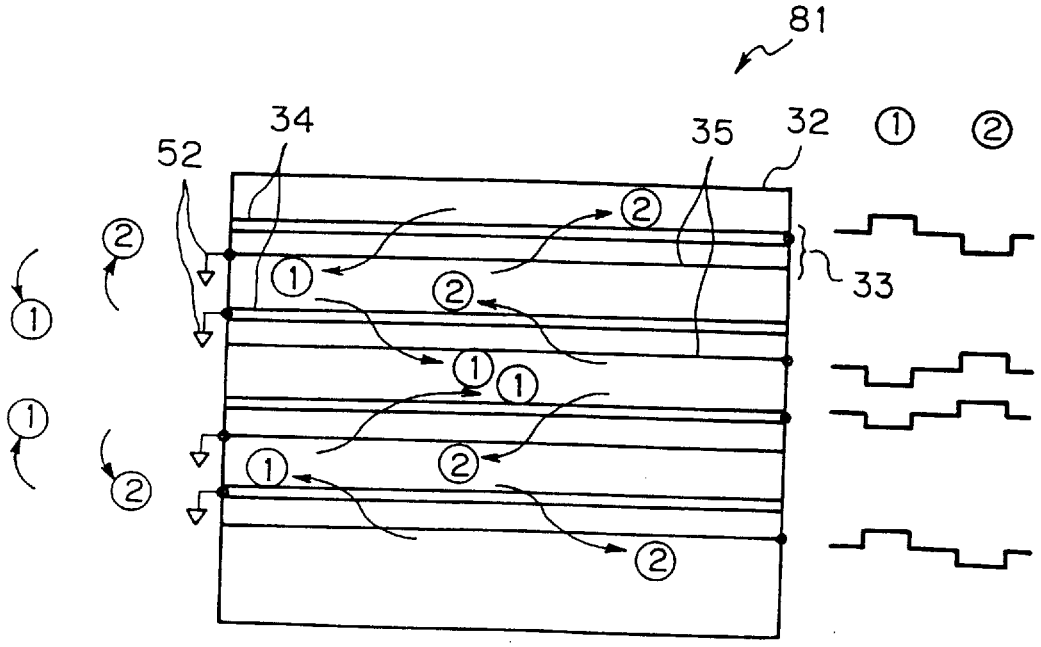
FIG. 13 is a schematic view showing a plasma display panel of a sixth embodiment of the present invention.

In the following, a sixth embodiment of the present invention is described with reference to FIG. 13. It is to be noted that same elements of the present sixth embodiment as those of the fifth embodiment described above are referred to by same names and reference numerals, and detailed description of them is omitted here.

In plasma display panel 81 of the present embodiment, where a group is formed from a pair of adjacent surface discharge electrodes 33 of an odd-numbered row which is an odd-numbered set and an even-numbered row which is an even-numbered set, the positive and negative polarities of sustain pulses applied to scanning electrodes 34 of surface discharge electrodes 33 of the even-numbered rows are opposite to each other and the positive and negative polarities of sustain pulses applied to scanning electrodes 34 of surface discharge electrodes 33 of the even-numbered rows are opposite to each other between odd-numbered groups and even-numbered groups.

In particular, in the first condition ①, positive sustain pulses are applied to scanning electrodes 34 of surface discharge electrodes 33 of the (4a+1)th rows (a is an integer larger than 0) and sustain electrodes 35 of surface discharge electrodes 33 of the (4a+4)th rows, and negative sustain pulses are applied to sustain electrodes 35 of surface discharge electrodes 33 of the (4a+2)th rows and scanning electrodes 34 of surface discharge electrodes 33 of the (4a+3)th rows.

On the other hand, in the second condition ②, negative sustain pulses are applied to scanning electrodes 34 of surface discharge electrodes 33 of the (4a+1)th rows and sustain electrodes 35 of surface discharge electrodes 33 of the (4a+4)th rows, and positive sustain pulses are applied to sustain electrodes 35 of surface discharge electrodes 33 of the (4a+2)th rows and scanning electrodes 34 of surface discharge electrodes 33 of the (4a+3)th rows.

In plasma display panel 81 of the present sixth embodiment having such a construction as described above, since the feeding directions of sustain pulses of surface discharge electrodes 33 of the odd-numbered rows and the even-numbered rows are opposite to each other in both of the first and second conditions ① and ②, magnetic noises cancel each other. Further, since the positive and negative polarities of sustain pulses of surface discharge electrodes 33 in the odd-numbered rows and the even-numbered rows are opposite to each other, also electric field noises cancel each other.

Besides, since the positive and negative polarities of sustain pulses applied to electrodes 34, 35 of adjacent surface discharge electrodes 33 are opposite to each other, the voltage discharged to grounding electrodes 52 is very low and also ground noise is reduced.

Furthermore, since the potential difference between adjacent surface discharge electrodes 33 is small, wall charge is not written in error into the position of any pixel which is not to be lit, and an image can be displayed with a good quality.

Figure 14:
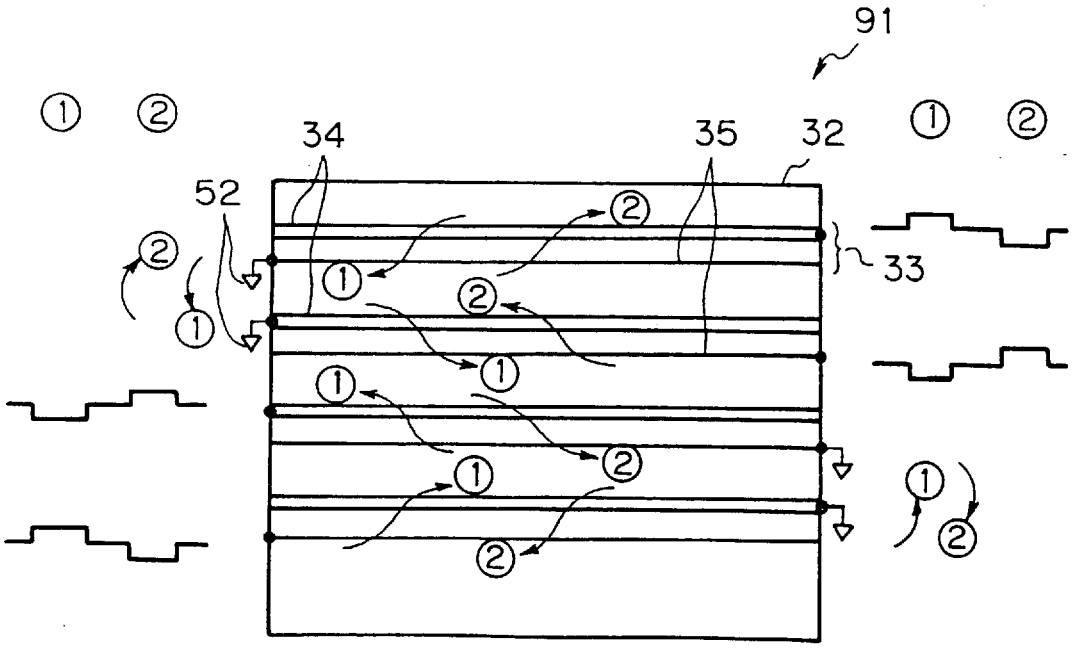
FIG. 14 is a schematic view showing a plasma display panel of a seventh embodiment of the present invention.

In the following, a seventh embodiment of the present invention is described with reference to FIG. 14. It is to be noted that same elements of the present seventh embodiment as those of the sixth embodiment described above are referred to by same names and reference numerals, and detailed description of them is omitted here.

In plasma display panel 91 of the present embodiment, where a group is formed from a pair of adjacent surface discharge electrodes 33 of an odd-numbered row which is an odd-numbered set and an even-numbered row which is an even-numbered set, the wiring line structures for scanning electrodes 34 and sustain electrodes 35 are symmetrical in the leftward and rightward direction which is the row direction between odd-numbered groups and even-numbered groups.

In particular, in surface discharge electrodes 33 of the (4a+1)th rows (a is an integer larger than 0), scanning drivers 42 are connected to the right ends of scanning electrodes 34 while grounding electrodes 52 are connected to the left ends of sustain electrodes 35 through ground drivers 53.

In surface discharge electrodes 33 of the (4a+2)th rows, grounding electrodes 52 are connected to the left ends of scanning electrodes 34 through ground drivers 53 while sustain drivers 44 are connected to the right ends of sustain electrodes 35.

Further, in surface discharge electrodes 33 of the (4a+3)th rows, scanning drivers 42 are connected to the left ends of scanning electrodes 34 while grounding electrodes 52 are connected to the right ends of sustain electrodes 35 through ground drivers 53.

In surface discharge electrodes 33 of the (4a+4)th rows, grounding electrodes 52 are connected to the right ends of scanning electrodes 34 through ground drivers 53 while sustain drivers 44 are connected to the left ends of sustain electrodes 35.

In the first condition ①, positive sustain pulses are applied to scanning electrodes 34 of surface discharge electrodes 33 of the (4a+1)th rows and sustain electrodes 35 of surface discharge electrodes 33 of the (4a+4)th rows while negative sustain pulses are applied to sustain electrodes 35 of surface discharge electrodes 33 of the (4a+2)th rows and scanning electrodes 34 of surface discharge electrodes 33 of the (4a+3)th rows.

On the other hand, in the second condition ②, negative sustain pulses are applied to scanning electrodes 34 of surface discharge electrodes 33 of the (4a+1)th rows and sustain electrodes 35 of surface discharge electrodes 33 of the (4a+4)th rows, and positive sustain pulses are applied to sustain electrodes 35 of surface discharge electrodes 33 of the (4a+2)th rows and scanning electrodes 34 of surface discharge electrodes 33 of the (4a+3)th rows are applied.

In plasma display panel 91 of the present seventh embodiment having such a construction as described above, since the feeding directions of sustain pulses of surface discharge electrodes 33 of the odd-numbered rows and the even-numbered rows are opposite to each other in both of the first and second conditions ① and ②, magnetic noises cancel each other. Further, since the positive and negative polarities of sustain pulses of surface discharge electrodes 33 in the odd-numbered rows and the even-numbered rows are opposite to each other, also electric field noises cancel each other.

Particularly, since, where a group is formed from a pair of adjacent surface discharge electrodes 33 of an odd-numbered row and an even-numbered row, the wiring line structures of scanning electrodes 34 and sustain electrodes 35 are symmetrical in the leftward and rightward direction between odd-numbered groups and even-numbered groups, formation of the scanning wiring lines and arrangement of scanning drivers 42 are easy.

Besides, since the positive and negative polarities of sustain pulses applied to electrodes 34, 35 of surface discharge electrodes 33 of the odd-numbered rows and the even-numbered rows are opposite to each other, the voltage discharged to grounding electrodes 52 is very low and also ground noise is reduced.

However, since the potential difference between adjacent surface discharge electrodes 33 is small, wall charge is not written in error into the position of any pixel which is not to be lit, and an image can be displayed with a good quality.

Figure 15:
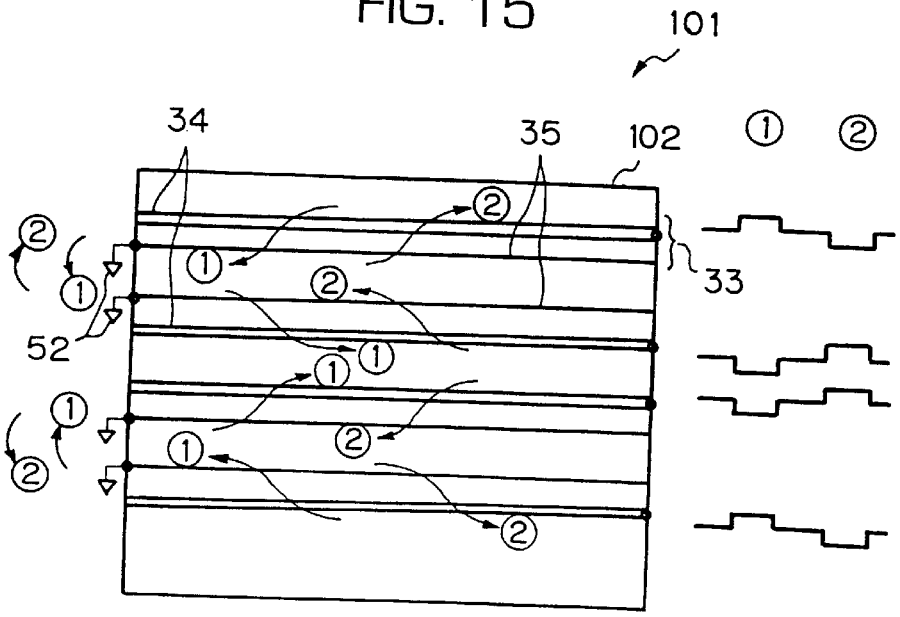
FIG. 15 is a schematic view showing a plasma display panel of an eighth embodiment of the present invention.

In the following, an eighth embodiment of the present invention is described with reference to FIG. 15. It is to be noted that same elements of the present eighth embodiment as those of the third embodiment described above are referred to by same names and reference numerals, and detailed description of them is omitted here.

Plasma display panel 101 of the present eighth embodiment is different from plasma display panel 51 described hereinabove as the third embodiment in the structure of display panel 102, in which the order of scanning electrodes 34 and sustain electrodes 35 in the column direction is alternately opposite between surface discharge electrodes 33 of odd-numbered rows which are odd-numbered sets and even-numbered rows which are even-numbered sets.

In particular, in surface discharge electrodes 33 of the odd-numbered rows, similarly as in plasma display panel 51 and so forth described hereinabove, scanning electrodes 34 and sustain electrodes 35 are arranged in order from above. However, in surface discharge electrodes 33 of the even-numbered rows, the order of scanning electrodes 34 and sustain electrodes is reversed.

Further, similarly as in plasma display panel 51 described hereinabove, grounding electrodes 52 are connected to the left ends of all of sustain electrodes through ground drivers 53, and scanning drivers 42 are connected to the right ends of all of scanning electrodes 34.

However, different from plasma display panel 51 described hereinabove, where a group is formed from a pair of adjacent surface discharge electrodes 33 of an odd-numbered row which is an odd-numbered set and an even-numbered row which is an even-numbered set, the positive and negative polarities of sustain pulses applied to scanning electrodes 34 of surface discharge electrodes 33 of the odd-numbered rows are opposite to each other and the positive and negative polarities of sustain pulses applied to scanning electrodes 34 of surface discharge electrodes 33 of the even-numbered rows are opposite to each other between odd-numbered groups and even-numbered groups.

In particular, in the first condition ①, positive sustain pulses are applied to scanning electrodes 34 of surface discharge electrodes 33 of the (4a+1)th (a is an integer equal to or larger than 1) rows and sustain electrodes 35 of surface discharge electrodes 33 of the (4a+4)th rows, and negative sustain pulses are applied to sustain electrodes 35 of surface discharge electrodes 33 of the (4a+2)th rows and scanning electrodes 34 of surface discharge electrodes 33 of the (4a+3)th rows.

On the other hand, in the second condition ②, negative sustain pulses are applied to scanning electrodes 34 of surface discharge electrodes 33 of the (4a+1)th rows and sustain electrodes 35 of surface discharge electrodes 33 of the (4a+4)th rows, and positive sustain pulses are applied to sustain electrodes 35 of surface discharge electrodes 33 of the (4a+2)th rows and scanning electrodes 34 of surface discharge electrodes 33 of the (4a+3)th rows.

In plasma display panel 101 of the present eighth embodiment having such a construction as described above, since the feeding directions of sustain pulses in surface discharge electrodes 33 of the odd-numbered rows and the even-numbered rows are opposite to each other in both of the first and second conditions ① and ②, magnetic noises cancel each other. Further, since the positive and negative polarities of sustain pulses of surface discharge electrodes 33 of the odd-numbered rows and the even-numbered rows are opposite to each other, also electric field noises cancel each other.

Besides, since the positive and negative polarities of sustain pulses of electrodes 34, 35 in surface discharge electrodes 33 of the odd-numbered rows and the even-numbered rows are opposite to each other, the voltage discharged to grounding electrodes 52 is very low and also ground noise is reduced.

However, since the potential difference between adjacent surface discharge electrodes 33 is small, wall charge is not written in error into the position of any pixel which is not to be lit, and an image can be displayed with a good quality.

Figure 16:
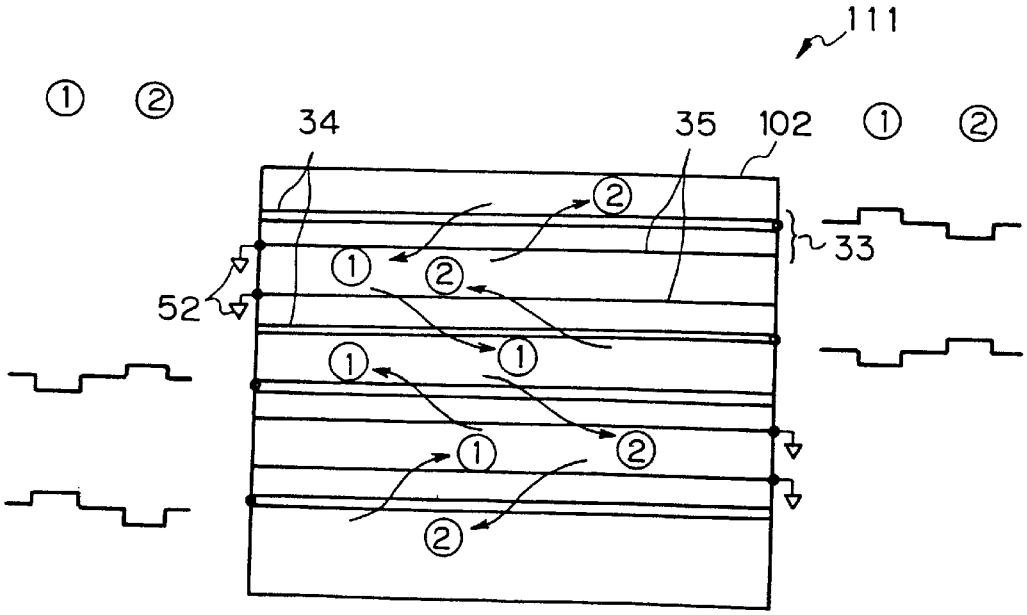
FIG. 16 is a schematic view showing a plasma display panel of a ninth embodiment of the present invention.

In the following, a ninth embodiment of the present invention is described with reference to FIG. 16. It is to be noted that same elements of the present ninth embodiment as those of the eighth embodiment described above are referred to by same names and reference numerals, and detailed description of them is omitted here.

In plasma display panel 111 of the present ninth embodiment, similarly as in plasma display panel 101 described above, the order of scanning electrodes 34 and sustain electrodes 35 in the column direction is alternately opposite between surface discharge electrodes 33 of odd-numbered rows which are odd-numbered sets and even-numbered rows which are even-numbered sets.

However, different from plasma display panel 101 described above, where a group is formed from a pair of adjacent surface discharge electrodes 33 of an odd-numbered row and an even-numbered row, the wiring line structures for scanning electrodes 34 and sustain electrodes 35 are symmetrical in the leftward and rightward direction which is the row direction between odd-numbered groups and even-numbered groups.

In particular, in surface discharge electrodes 33 of the (4a+1)th rows (a is an integer larger than 0) and the (4a+2)th rows, scanning drivers 42 are connected to the right ends of scanning electrodes 34 while grounding electrodes 52 are connected to the left ends of sustain electrodes 35 through ground drivers 53.

In surface discharge electrodes 33 of the (4a+3)th rows and the (4a+4)th rows, scanning drivers 42 are connected to the left ends of scanning electrodes 34 while grounding electrodes 52 are connected to the right ends of sustain electrodes 35 through ground drivers 53.

In plasma display panel 111 of the present ninth embodiment having such a construction as described above, since the feeding directions of sustain pulses in surface discharge electrodes 33 of the odd-numbered rows and the even-numbered rows are opposite to each other in both of the first and second conditions ① and ②, magnetic noises cancel each other. Further, since the positive and negative polarities of sustain pulses of surface discharge electrodes 33 in the odd-numbered rows and the even-numbered rows are opposite to each other, also electric field noises cancel each other.

Particularly, since, where a group is formed from a pair of adjacent surface discharge electrodes 33 of an odd-numbered row and an even-numbered row, the wiring line structures for surface discharge electrodes 33 are symmetrical in the leftward and rightward direction, formation of the scanning wiring lines and arrangement of scanning drivers 42 are easy.

Besides, since the positive and negative polarities of sustain pulses applied to electrodes 34, 35 in surface discharge electrodes 33 of the odd-numbered rows and the even-numbered rows are opposite to each other, the voltage discharged to grounding electrodes 52 is very low and also ground noise is reduced.

However, since the potential difference between adjacent surface discharge electrodes 33 is small, wall charge is not written in error into the position of any pixel which is not to be lit, and an image can be displayed with a good quality.

Figure 17:
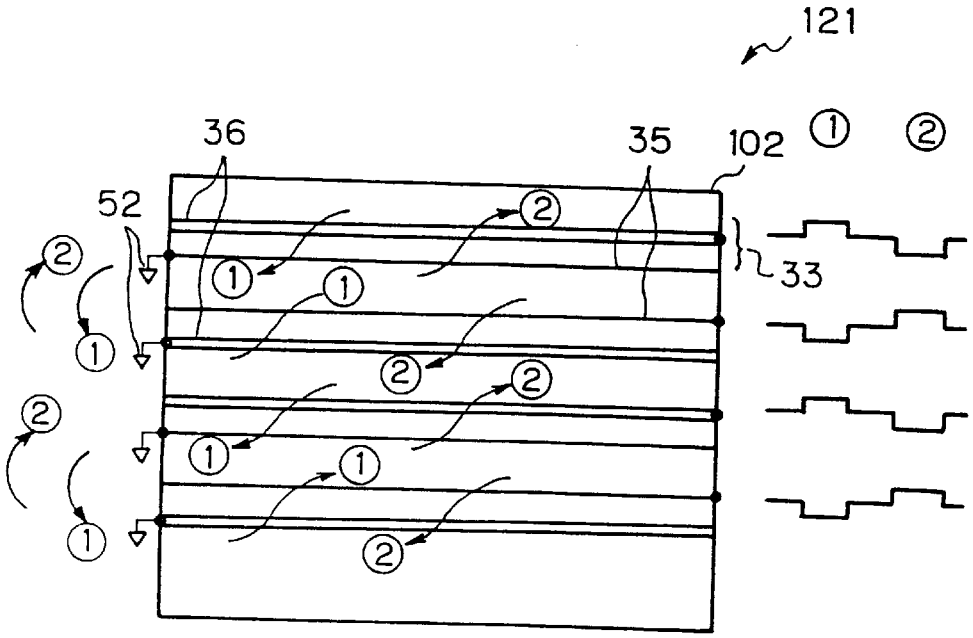
FIG. 17 is a schematic view showing a plasma display panel of a tenth embodiment of the present invention.

In the following, a tenth embodiment of the present invention is described with reference to FIG. 17. It is to be noted that same elements of the present tenth embodiment as those of the eighth embodiment described above are referred to by same names and reference numerals, and detailed description of them is omitted here.

In plasma display panel 121 of the present tenth embodiment, similarly as in plasma display panel 101 described hereinabove as the eighth embodiment, the order of scanning electrodes 34 and sustain electrodes 35 in the column direction is alternately opposite between surface discharge electrodes 33 of odd-numbered rows which are odd-numbered sets and even-numbered rows which are even-numbered sets.

However, different from plasma display panel 101 described above, scanning electrodes 34 and sustain electrodes 35 are connected alternately to grounding electrodes 52 between surface discharge electrodes 33 of the odd-numbered rows which are odd-numbered sets and the even-numbered rows which are even-numbered sets.

To the scanning electrodes 34 and sustain electrodes 35 which are not connected to grounding electrodes 52, scanning drivers 42 and sustain drivers 44 which generate sustain pulses whose positive and negative polarities are alternately reversed are connected.

In plasma display panel 121 of the present tenth embodiment, when sustain pulses whose direction are reversed between the first condition ① and the second condition ② are applied, voltages whose positive and negative polarities are opposite to each other between surface discharge electrodes 33 of the odd-numbered rows and the even-numbered rows are applied to the electrodes 34, 35 to which the ground potential is not applied.

In particular, in the first condition ①, positive sustain pulses are applied to scanning electrodes 34 of surface discharge electrodes 33 of the odd-numbered rows while negative sustain pulses are applied to sustain electrodes 35 of surface discharge electrodes 33 of the even-numbered rows.

In the second condition ②, negative sustain pulses are applied to scanning electrodes 34 of surface discharge electrodes 33 of the odd-numbered rows while positive sustain pulses are applied to sustain electrodes 35 of surface discharge electrodes 33 of the even-numbered rows.

In plasma display panel 121 of the present tenth embodiment having such a construction as described above, since the feeding directions of sustain pulses in surface discharge electrodes 33 of the odd-numbered rows and the even-numbered rows are opposite to each other in both of the first and second conditions ① and ②, magnetic noises cancel each other. Further, since the positive and negative polarities of sustain pulses of surface discharge electrodes 33 in the odd-numbered rows and the even-numbered rows are opposite to each other, also electric field noises cancel each other.

Besides, since the positive and negative polarities of sustain pulses applied to electrodes 34, 35 of surface discharge electrodes 33 of the odd-numbered rows and the even-numbered rows are opposite to each other, the voltage discharged to grounding electrodes 52 is very low and also ground noise is reduced.

However, since the potential difference between adjacent surface discharge electrodes 33 is small, wall charge is not written in error into the position of any pixel which is not to be lit, and an image can be displayed with a good quality.

Further, the voltages of sustain pulses are distributed to the positive and negative polarities and also the potential differences between electrodes 34, 35 and the data electrodes are small, an image can be distributed with a good quality also in this regard.

Figure 18:
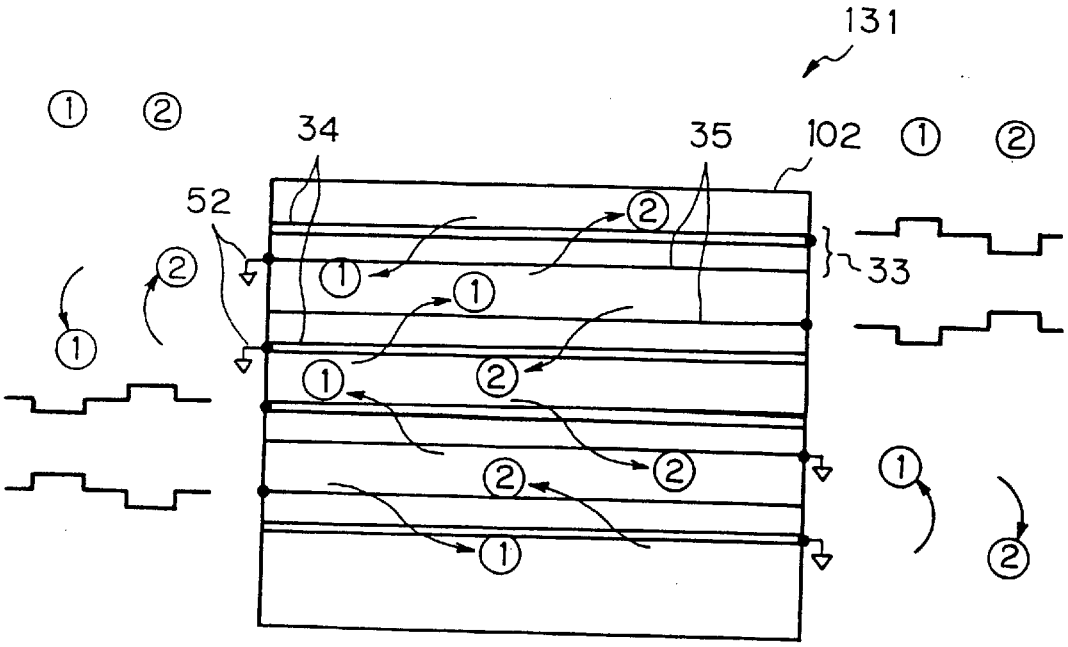
FIG. 18 is a schematic view showing a plasma display panel of an eleventh embodiment of the present invention.

In the following, an eleventh embodiment of the present invention is described with reference to FIG. 18. It is to be noted that same elements of the present eleventh embodiment as those of the tenth embodiment described above are referred to by same names and reference numerals, and detailed description of them is omitted here.

In plasma display panel 131 of the present eleventh embodiment, similarly as in plasma display panel 121 described above as the tenth embodiment, the order of scanning electrodes 34 and sustain electrodes 35 in the column direction is alternately opposite between surface discharge electrodes 33 of odd-numbered rows which are odd-numbered sets and even-numbered rows which are even-numbered sets and scanning electrodes 34 and sustain electrodes 35 are connected alternately to grounding electrodes 52.

Further, to the electrodes 34, 35 which are not connected to grounding electrodes 52, scanning drivers 42 and sustain drivers 44 which generate sustain pulses whose positive and negative polarities are reversed alternately are connected.

However, different from plasma display panel 121 described above, where a group is formed from a pair of adjacent surface discharge electrodes 33 of an odd-numbered row and an even-numbered row, the wiring line structures for scanning electrodes 34 and sustain electrodes 35 are symmetrical in the leftward and rightward direction which is the row direction between odd-numbered groups and even-numbered groups.

In particular, in surface discharge electrodes 33 of the (4a+1)th rows (a is an integer larger than 0), scanning drivers 42 are connected to the right ends of scanning electrodes 34 while grounding electrodes 52 are connected to the left ends of sustain electrodes 35 through ground drivers 53.

In surface discharge electrodes 33 of the (4a+2)th rows, grounding electrodes 52 are connected to the left ends of scanning electrodes 34 through ground drivers 53 while sustain drivers 44 are connected to the right ends of sustain electrodes 35.

In surface discharge electrodes 33 of the (4a+3)th rows, scanning drivers 42 are connected to the left ends of scanning electrodes 34 while grounding electrodes 52 are connected to the right ends of sustain electrodes 35 through ground drivers 53.

In surface discharge electrodes 33 of the (4a+4)th rows, grounding electrodes 52 are connected to the right ends of scanning electrodes 34 through ground drivers 53 while sustain drivers 44 are connected to the left ends of sustain electrodes 35.

In plasma display panel 131 of the present tenth embodiment, when sustain pulses whose directions are reversed between the first condition ① and the second condition ② are applied, voltages whose positive and negative polarities are opposite to each other between surface discharge electrodes 33 of the odd-numbered rows and the even-numbered rows are applied to the electrodes 34, 35 to which the ground potential is not applied.

Further, where a group is formed from a pair of adjacent surface discharge electrodes 33 of an odd-numbered row which is an odd-numbered set and an even-numbered row which is an even-numbered set, the positive and negative polarities of sustain pulses applied to scanning electrodes 34 of surface discharge electrodes 33 of the odd-numbered rows are opposite to each other and the positive and negative polarities of sustain pulses applied to scanning electrodes 34 of surface discharge electrodes 33 of the even-numbered rows are opposite to each other between odd-numbered groups and even-numbered groups.

In particular, in the first condition ①, positive sustain pulses are applied to scanning electrodes 34 of surface discharge electrodes 33 of the (4a+1)th (a is an integer equal to or larger than 1) rows and sustain electrodes 35 of surface discharge electrodes 33 of the (4a+4)th rows, and negative sustain pulses are applied to sustain electrodes 35 of surface discharge electrodes 33 of the (4a+2)th rows and scanning electrodes 34 of surface discharge electrodes 33 of the (4a+3)th rows.

On the other hand, in the second condition ②, negative sustain pulses are applied to scanning electrodes 34 of surface discharge electrodes 33 of the (4a+1)th rows and sustain electrodes 35 of surface discharge electrodes 33 of the (4a+4)th rows, and positive sustain pulses are applied to sustain electrodes 35 of surface discharge electrodes 33 of the (4a+2)th rows and scanning electrodes 34 of surface discharge electrodes 33 of the (4a+3)th rows.

In plasma display panel 131 of the present eleventh embodiment having such a construction as described above, since the feeding directions of sustain pulses in surface discharge electrodes 33 of the odd-numbered rows and the even-numbered rows are opposite to each other in both of the first and second conditions ① and ②, magnetic noises cancel each other. Further, since the positive and negative polarities of sustain pulses of surface discharge electrodes 33 of the odd-numbered rows and the even-numbered rows are opposite to each other, also electric field noises cancel each other.

Particularly, since, where a group is formed from a pair of adjacent surface discharge electrodes 33 of an odd-numbered row and an even-numbered row, the wiring line structures for surface discharge electrodes 33 are symmetrical in the leftward and rightward direction between odd-numbered groups and even-numbered groups, formation of the scanning wiring lines and arrangement of scanning drivers 42 are easy.

Besides, since the positive and negative polarities of sustain pulses applied to electrodes 34, 35 of surface discharge electrodes 33 of the odd-numbered rows and the even-numbered rows are opposite to each other, the voltage discharged to grounding electrodes 52 is very low and also ground noise is reduced.

However, since the potential difference between adjacent surface discharge electrodes 33 is small, wall charge is not written in error into the position of any pixel which is not to be lit, and an image can be displayed with a good quality.

Figure 19:
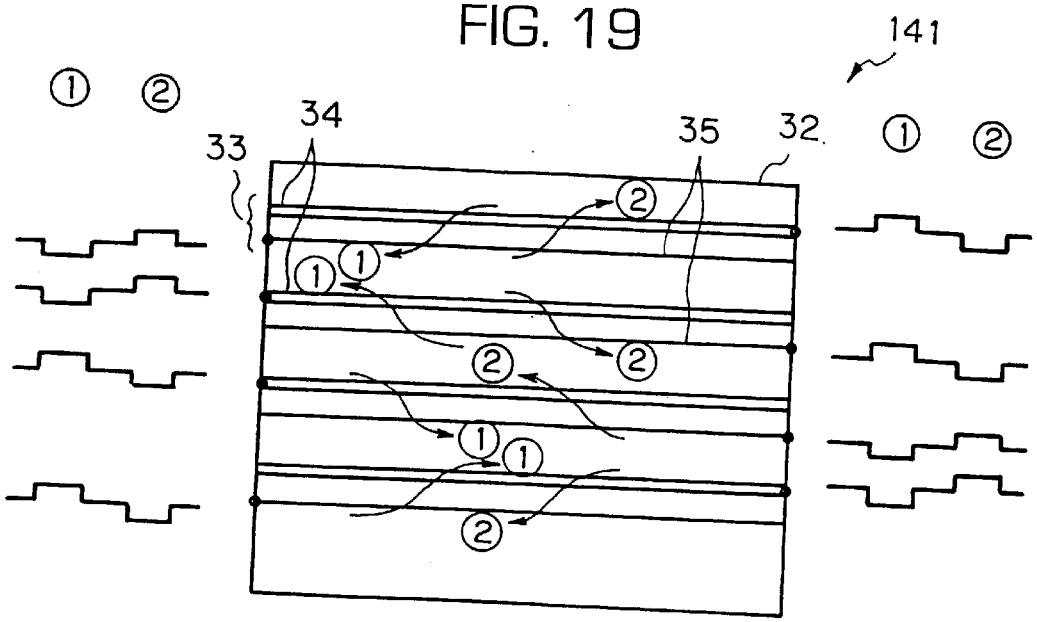
FIG. 19 is a schematic view showing a plasma display panel of a twelfth embodiment of the present invention.

In the following, a twelfth embodiment of the present invention is described with reference to FIG. 19. It is to be noted that same elements of the present twelfth embodiment as those of the second embodiment described above are referred to by same names and reference numerals, and detailed description of them is omitted here.

In plasma display panel 141 of the present twelfth embodiment, the wiring line structures for scanning electrodes 34 and sustain electrodes 35 are symmetrical in the leftward and rightward direction, which is the row direction, between odd-numbered sets which are odd-numbered rows and even-numbered sets which are even-numbered rows.

Further, where a group is formed from a pair of adjacent surface discharge electrodes 33 of an odd-numbered row which is an odd-numbered set and an even-numbered row which is an even-numbered set, the wiring line structures for scanning electrodes 34 and sustain electrodes 35 are symmetrical in the leftward and rightward direction, which is the row direction, between odd-numbered groups and even-numbered groups.

In particular, in surface discharge electrodes 33 of the (4a+1)th rows (a is an integer larger than 0) and the (4a+4)th rows, scanning drivers 42 are connected to the right ends of scanning electrodes 34 while sustain drivers 44 are connected to the left ends of sustain electrodes 35.

In surface discharge electrodes 33 of the (4a+2)th rows and the (4a+3)th rows, scanning drivers 42 are connected to the left ends of scanning electrodes 34 while sustain drivers 44 are connected to the right ends of sustain electrodes 35.

Also in plasma display panel 141 of the present twelfth embodiment, similarly as in plasma display panel 141 described hereinabove as the second embodiment, when sustain pulses whose directions are reversed between the first condition ① and the second condition ② are fed to surface discharge electrodes 33, voltages whose positive and negative polarities are opposite to each other are applied to scanning electrodes 34 and sustain electrodes 35 by scanning drivers 42 and sustain drivers 44.

In particular, in the first condition ①, positive sustain pulses are applied to scanning electrodes 34 of surface discharge electrodes 33 of the odd-numbered rows and sustain electrodes 35 of surface discharge electrodes 33 of the even-numbered rows while negative sustain pulses are applied to scanning electrodes 34 of surface discharge electrodes 33 of the even-numbered rows and sustain electrodes 35 of surface discharge electrodes 33 of the odd-numbered rows.

In the second condition ②, negative sustain pulses are applied to scanning electrodes 34 of surface discharge electrodes 33 of the odd-numbered rows and sustain electrodes 35 of surface discharge electrodes 33 of the even-numbered rows while positive sustain pulses are applied to scanning electrodes 34 of surface discharge electrodes 33 of the even-numbered rows and sustain electrodes 35 of surface discharge electrodes 33 of the odd-numbered rows.

Also in plasma display panel 141 of the present twelfth embodiment having such a construction as described above, similarly as in plasma display panel 41 described hereinabove as the second embodiment, the positive and negative polarities of sustain pulses applied to electrodes 34, 35 in surface discharge electrodes 33 of the odd-numbered rows and the even-numbered rows are opposite to each other in both of the first and second conditions ① and ②, and consequently, also electric field noises cancel each other.

Besides, since the positive and negative polarities of sustain pulses applied to electrodes 34, 35 of surface discharge electrodes 33 of the odd-numbered rows and the even-numbered rows are opposite to each other, the voltage discharged to grounding electrodes 52 is very low and also ground noise is reduced.

However, since the potential difference between adjacent surface discharge electrodes 33 is small, wall charge is not written in error into the position of any pixel which is not to be lit, and an image can be displayed with a good quality.

It is to be noted, however, that, in plasma display panel 141 of the present embodiment, the feeding directions of sustain pulses through surface discharge electrodes 33 are same in the odd-numbered rows and the even-numbered rows, but are opposite between the odd-numbered groups and the even-numbered groups each composed of two rows.

In particular, the feeding direction of sustain pulses is opposite between an odd-numbered group and an even-numbered group each including two rows of surface discharge electrodes 33, and magnetic noises of surface discharge electrodes 33 cancel each other in units of such two rows.

In the following, a thirteenth embodiment of the present invention is described with reference to FIG. 20. It is to be noted that same elements of the present thirteenth embodiment as those of the second embodiment described above are referred to by same names and reference numerals, and detailed description of them is omitted here.

In plasma display panel 151 of the present embodiment, scanning drivers 42 and sustain drivers 44 which generate voltages, whose positive and negative polarities are reversed alternately, as sustain pulses are connected to the opposite ends of all of scanning electrodes 34 and sustain electrodes 35.

Further, in plasma display panel 151 of the present embodiment, when sustain pulses whose directions are reversed in the first condition ① and the second condition ② are fed to surface discharge electrodes 33, voltages whose positive and negative polarities are opposite to each other are applied to scanning electrodes 34 and sustain electrodes 35 by scanning drivers 42 and sustain drivers 44.

Furthermore, the positive and negative polarities of voltages to be applied as sustain pulses to sustain electrodes 35 are opposite between surface discharge electrodes 33 of odd-numbered rows which are odd-numbered sets and even-numbered rows which are even-numbered sets, and also the positive and negative polarities of voltages to be applied as sustain pulses to positive driver 36 are opposite to each other.

In particular, in the first condition ①, positive sustain pulses are applied to the opposite ends of scanning electrodes 34 of surface discharge electrodes 33 of the odd-numbered rows and the opposite ends of sustain electrodes 35 of surface discharge electrodes 33 of the even-numbered rows while negative sustain pulses are applied between the opposite ends of sustain electrodes 35 of surface discharge electrodes 33 of the odd-numbered rows and the opposite ends of scanning electrodes 34 of surface discharge electrodes 33 of the even-numbered rows.

On the other hand, in the second condition ②, negative sustain pulses are applied to the opposite ends of scanning electrodes 34 of surface discharge electrodes 33 of the odd-numbered rows and the opposite ends of sustain electrodes 35 of surface discharge electrodes 33 of the even-numbered rows while positive sustain pulses are applied between the opposite ends of sustain electrodes 35 of surface discharge electrodes 33 of the odd-numbered rows and the opposite ends of scanning electrodes 34 of surface discharge electrodes 33 of the even-numbered rows.

Also in plasma display panel 151 of the present thirteenth embodiment having such a construction as described above, similarly as in plasma display panel 41 described hereinabove as the second embodiment, sustain pulses are applied as voltages of both of the positive and negative polarities to scanning electrodes 34 and sustain electrodes 35 in both of the first and second conditions ① and ②, and consequently, even if sustain pulses of a high voltage are fed, production of electric field noise is prevented.

Besides, since the positive and negative polarities of sustain pulses applied to electrodes 34, 35 in surface discharge electrodes 33 of the odd-numbered rows and the even-numbered rows are opposite to each other, the voltage discharged to grounding electrodes 52 is very low and also ground noise is reduced.

However, since the potential difference between adjacent surface discharge electrodes 33 is small and also the potential differences between electrodes 34, 35 and the data electrodes are small, wall charge is not written in error into the position of any pixel which is not to be lit, and an image can be displayed with a good quality.

Figure 20:
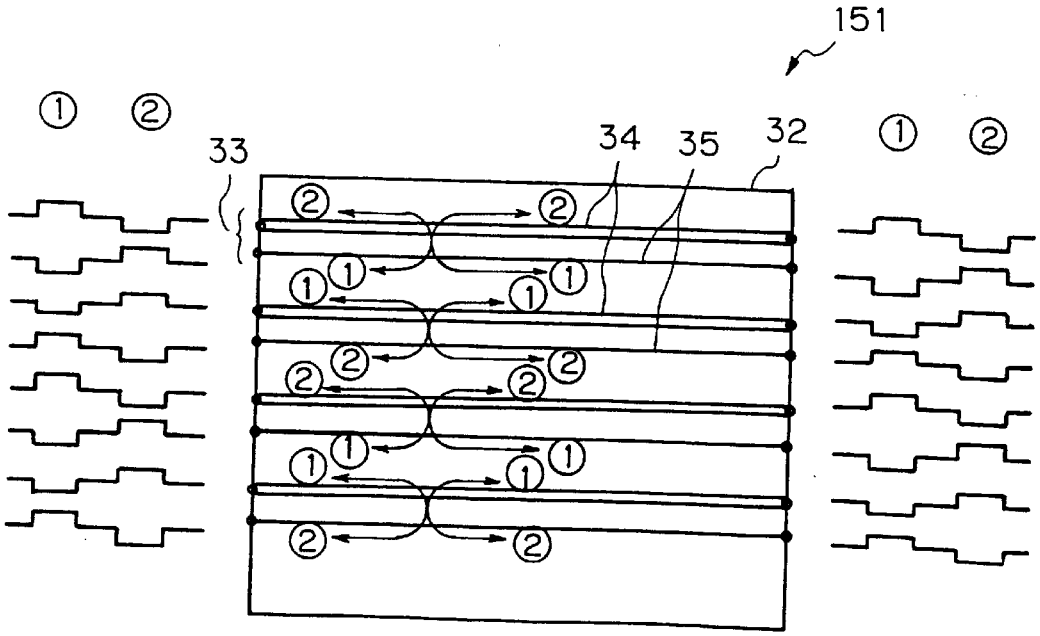
FIG. 20 is a schematic view showing a plasma display panel of a thirteenth embodiment of the present invention.

Further, in plasma display panel 151 of the present embodiment, since voltages serving as sustain pulses are applied to all of electrodes 34, 35 from the opposite ends of them, also feeding routes of the sustain pulses are distributed to both of the left and right as seen in FIG. 20.

Since the feeding directions of the sustain pulses distributed in this manner are opposite to each other in the odd-numbered rows and the even-numbered rows of surface discharge electrodes 33, magnetic noises cancel each other very well.

Figure 21:
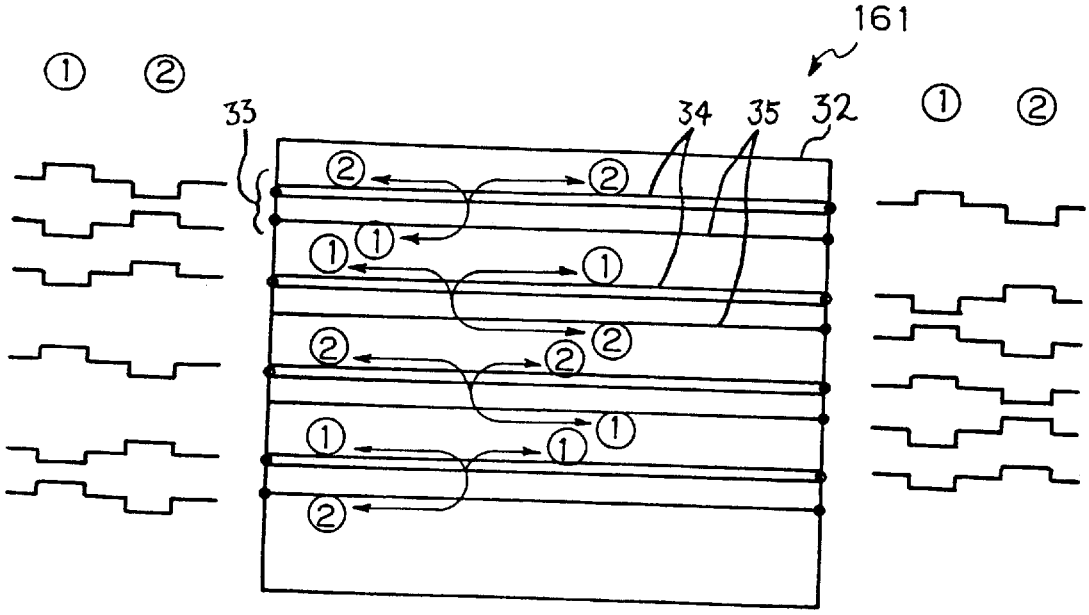
FIG. 21 is a schematic view showing a plasma display panel of a fourteenth embodiment of the present invention.

In the following, a fourteenth embodiment of the present invention is described with reference to FIG. 21. It is to be noted that same elements of the present fourteenth embodiment as those of the thirteenth embodiment described above are referred to by same names and reference numerals, and detailed description of them is omitted here.

In plasma display panel 161 of the present fourteenth embodiment, scanning drivers 42 which generate voltages, whose positive and negative polarities are reversed alternately, as sustain pulses are connected to the opposite ends of all of scanning electrodes 34.

However, sustain drivers 44 which generate voltages, whose positive and negative polarities are reversed alternately, as sustain pulses are connected to only one of the ends of sustain electrodes 35 which are alternately opposite between odd-numbered rows of surface discharge electrodes 33 which are odd-numbered sets and even-numbered rows of surface discharge electrodes 33 which are even-numbered sets.

Also in plasma display panel 161 of the present fourteenth embodiment having such a construction as described above, similarly as in plasma display panel 151 described hereinabove as the thirteenth embodiment, sustain pulses are applied as voltages of both of the positive and negative polarities to scanning electrodes 34 and sustain electrodes 35 in both of the first and second conditions ① and ②, and consequently, even if sustain pulses of a high voltage are fed, production of electric field noise is prevented.

Besides, since the positive and negative polarities of sustain pulses applied to electrodes 34, 35 in surface discharge electrodes 33 of the odd-numbered rows and the even-numbered rows are opposite to each other, the voltage discharged to grounding electrodes 52 is very low and also ground noise is reduced.

However, since the potential difference between adjacent surface discharge electrodes 33 is small and also the potential differences between electrodes 34, 35 and the data electrodes are small, wall charge is not written in error into the position of any pixel which is not to be lit, and an image can be displayed with a good quality.

Further, in plasma display panel 161 of the present embodiment, voltages serving as sustain pulses are applied to scanning electrodes 34 from the opposite ends of them and applied to sustain electrodes 35 from one ends whose positions are opposite between the odd-numbered rows and the even-numbered rows of surface discharge electrodes 33.

Consequently, the sustain pulses to be fed to surface discharge electrodes 33 are distributed to both of the left and right with regard to scanning electrodes 34 while the feeding directions are opposite between the odd-numbered rows and the even-numbered rows with regard to sustain electrodes 35, and consequently, magnetic noises cancel each other very well.

While preferred embodiments of the present invention have been described using specific terms, such description is for illustrative purposes only, and it is to be understood that changes and variations may be made without departing from the spirit or scope of the following claims.

What is claimed is:

1. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written; and pulse feeding control means for making, when said surface discharge electrodes of a predetermined number of one or more rows arranged successively in the column direction are defined as a set, positive and negative polarities of the sustain pulses opposite between said surface discharge electrodes of odd-numbered sets and even-numbered sets.

2. A plasma display panel as claimed in claim 1, wherein said sustain pulse feeding means is connected to the opposite ends of said scanning electrodes.

3. A plasma display panel as claimed in claim 1, wherein said sustain pulse feeding means is connected to the opposite ends of said sustain electrodes.

4. A plasma display panel as claimed in claim 1, wherein, when a pair of adjacent electrodes of said surface discharge electrodes of an odd-numbered set and an even-numbered set are defined as a group, wiring line structures for said scanning electrodes and said sustain electrodes are symmetrical in the row direction between odd-numbered groups and even-numbered groups of said surface discharge electrodes.

5. A plasma display panel as claimed in claim 1, wherein, when said surface discharge electrodes of a predetermined number of one or more rows arranged successively in the column direction are defined as a set, orders of said scanning electrodes and said sustain electrodes are alternately opposite to each other between odd-numbered sets and even-numbered sets of said surface discharge electrodes.

6. A plasma display panel as claimed in claim 1, further comprising means for making, when said surface discharge electrodes of a predetermined number of one or more rows arranged successively in the column direction are defined as a set, feeding directions of the sustain pulses opposite to each other between said surface discharge electrodes of odd-numbered sets and even-numbered sets.

7. A plasma display panel as claimed in claim 1, further comprising means for making the polarities of voltages applied as the sustain pulses to adjacent electrodes of said scanning electrodes and said sustain electrodes on boundaries between odd-numbered sets and even-numbered sets of said surface discharge electrodes of the same polarity.

8. A plasma display panel as claimed in claim 1, further comprising means for making the polarities of voltages applied as the sustain pulses to adjacent electrodes of said scanning electrodes on boundaries between odd-numbered sets and even-numbered sets of said surface discharge electrodes of the same polarity.

9. A plasma display panel as claimed in claim 1, further comprising means for making the polarities of voltages applied as the sustain pulses to adjacent electrodes of said sustain electrodes on boundaries between odd-numbered sets and even-numbered sets of said surface discharge electrodes of the same polarity.

10. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written;

ground potential application means for applying a ground potential to all of said scanning electrodes; and pulse feeding control means for causing, when said surface discharge electrodes of a predetermined number of one or more rows arranged successively in the column direction are defined as a set, said sustain pulse feeding means to apply voltages, whose positive and negative polarities are opposite between odd-numbered sets and even-numbered sets of said surface discharge electrodes, as the sustain pulses to said sustain electrodes.

11. A plasma display panel as claimed in claim 10, wherein said sustain pulse feeding means is connected to the opposite ends of said sustain electrodes.

12. A plasma display panel as claimed in claim 10, wherein, when a pair of adjacent electrodes of said surface discharge electrodes of an odd-numbered set and an even-numbered set are defined as a group, wiring line structures for said scanning electrodes and said sustain electrodes are symmetrical in the row direction between odd-numbered groups and even-numbered groups of said surface discharge electrodes.

13. A plasma display panel as claimed in claim 10, wherein, when said surface discharge electrodes of a predetermined number of one or more rows arranged successively in the column direction are defined as a set, orders of said scanning electrodes and said sustain electrodes are alternately opposite to each other between odd-numbered sets and even-numbered sets of said surface discharge electrodes.

14. A plasma display panel as claimed in claim 10, further comprising means for making, when said surface discharge electrodes of a predetermined number of one or more rows arranged successively in the column direction are defined as a set, feeding directions of the sustain pulses opposite to each other between said surface discharge electrodes of odd-numbered sets and even-numbered sets.

15. A plasma display panel as claimed in claim 10, further comprising means for making the polarities of voltages applied as the sustain pulses to adjacent electrodes of said scanning electrodes and said sustain electrodes on boundaries between odd-numbered sets and even-numbered sets of said surface discharge electrodes of the same polarity.

16. A plasma display panel as claimed in claim 10, further comprising means for making the polarities of voltages applied as the sustain pulses to adjacent electrodes of said scanning electrodes on boundaries between odd-numbered sets and even-numbered sets of said surface discharge electrodes of the same polarity.

17. A plasma display panel as claimed in claim 10, further comprising means for making the polarities of voltages applied as the sustain pulses to adjacent electrodes of said sustain electrodes on boundaries between odd-numbered sets and even-numbered sets of said surface discharge electrodes of the same polarity.

18. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written;

ground potential application means for applying a ground potential to all of said sustain electrodes; and pulse feeding control means for causing, when said surface discharge electrodes of a predetermined number of one or more rows arranged successively in the column direction are defined as a set, said sustain pulse feeding means to apply voltages, whose positive and negative polarities are opposite between odd-numbered sets and even-numbered sets of said surface discharge electrodes, as the sustain pulses to said scanning electrodes.

19. A plasma display panel as claimed in claim 18, wherein said sustain pulse feeding means is connected to the opposite ends of said scanning electrodes.

20. A plasma display panel as claimed in claim 18, wherein, when a pair of adjacent electrodes of said surface discharge electrodes of an odd-numbered set and an even-numbered set are defined as a group, wiring line structures for said scanning electrodes and said sustain electrodes are symmetrical in the row direction between odd-numbered groups and even-numbered groups of said surface discharge electrodes.

21. A plasma display panel as claimed in claim 18, wherein, when said surface discharge electrodes of a predetermined number of one or more rows arranged successively in the column direction are defined as a set, orders of said scanning electrodes and said sustain electrodes are alternately opposite to each other between odd-numbered sets and even-numbered sets of said surface discharge electrodes.

22. A plasma display panel as claimed in claim 18, further comprising means for making, when said surface discharge electrodes of a predetermined number of one or more rows arranged successively in the column direction are defined as a set, feeding directions of the sustain pulses opposite to each other between said surface discharge electrodes of odd-numbered sets and even-numbered sets.

23. A plasma display panel as claimed in claim 18, further comprising means for making the polarities of voltages applied as the sustain pulses to adjacent electrodes of said scanning electrodes and said sustain electrodes on boundaries between odd-numbered sets and even-numbered sets of said surface discharge electrodes of the same polarity.

24. A plasma display panel as claimed in claim 18, further comprising means for making the polarities of voltages applied as the sustain pulses to adjacent electrodes of said scanning electrodes on boundaries between odd-numbered sets and even-numbered sets of said surface discharge electrodes of the same polarity.

25. A plasma display panel as claimed in claim 18, further comprising means for making the polarities of voltages applied as the sustain pulses to adjacent electrodes of said sustain electrodes on boundaries between odd-numbered sets and even-numbered sets of said surface discharge electrodes of the same polarity.

26. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written;

ground potential application means for applying, when said surface discharge electrodes of a predetermined number of one or more rows arranged successively in the column direction are defined as a set, a ground potential alternately to said scanning electrodes and said sustain electrodes in odd-numbered sets and even-numbered sets of said surface discharge electrodes; and pulse feeding control means for causing said sustain pulse feeding means to apply voltages, whose positive and negative polarities are opposite between odd-numbered sets and even-numbered sets of said surface discharge electrodes, as the sustain pulses to those of said scanning electrodes and said sustain electrodes to which the ground potential is not applied.

27. A plasma display panel as claimed in claim 26, wherein said pulse feeding control means includes means for causing, when a pair of adjacent electrodes of said surface discharge electrodes of an odd-numbered set and an even-numbered set are defined as a group, the positive and negative polarities of the voltages applied as the sustain pulses to each odd-numbered set of said surface discharge electrodes to be reversed alternately and causing the positive and negative polarities of the voltages applied as the sustain pulses to each even-numbered set of said surface discharge electrodes to be reversed alternately, between odd-numbered groups and even-numbered groups of said surface discharge electrodes.

28. A plasma display panel as claimed in claim 27, wherein said sustain pulse feeding means is connected to the opposite ends of said scanning electrodes.

29. A plasma display panel as claimed in claim 27, wherein said sustain pulse feeding means is connected to the opposite ends of said sustain electrodes.

30. A plasma display panel as claimed in claim 27, wherein, when a pair of adjacent electrodes of said surface discharge electrodes of an odd-numbered set and an even-numbered set are defined as a group, wiring line structures for said scanning electrodes and said sustain electrodes are symmetrical in the row direction between odd-numbered groups and even-numbered groups of said surface discharge electrodes.

31. A plasma display panel as claimed in claim 27, wherein, when said surface discharge electrodes of a predetermined number of one or more rows arranged successively in the column direction are defined as a set, orders of said scanning electrodes and said sustain electrodes are alternately opposite to each other between odd-numbered sets and even-numbered sets of said surface discharge electrodes.

32. A plasma display panel as claimed in claim 27, further comprising means for making, when said surface discharge electrodes of a predetermined number of one or more rows arranged successively in the column direction are defined as a set, feeding directions of the sustain pulses opposite to each other between said surface discharge electrodes of odd-numbered sets and even-numbered sets.

33. A plasma display panel as claimed in claim 27, further comprising means for making the polarities of voltages applied as the sustain pulses to adjacent electrodes of said scanning electrodes and said sustain electrodes on boundaries between odd-numbered sets and even-numbered sets of said surface discharge electrodes of the same polarity.

34. A plasma display panel as claimed in claim 27, further comprising means for making the polarities of voltages applied as the sustain pulses to adjacent electrodes of said scanning electrodes on boundaries between odd-numbered sets and even-numbered sets of said surface discharge electrodes of the same polarity.

35. A plasma display panel as claimed in claim 27, further comprising means for making the polarities of voltages applied as the sustain pulses to adjacent electrodes of said sustain electrodes on boundaries between odd-numbered sets and even-numbered sets of said surface discharge electrodes of the same polarity.

36. A plasma display panel as claimed in claim 26, wherein, when a pair of adjacent electrodes of said surface discharge electrodes of an odd-numbered set and an even-numbered set are defined as a group, wiring line structures for said scanning electrodes and said sustain electrodes are symmetrical in the row direction between odd-numbered groups and even-numbered groups of said surface discharge electrodes.

37. A plasma display panel as claimed in claim 26, wherein, when said surface discharge electrodes of a predetermined number of one or more rows arranged successively in the column direction are defined as a set, orders of said scanning electrodes and said sustain electrodes are alternately opposite to each other between odd-numbered sets and even-numbered sets of said surface discharge electrodes.

38. A plasma display panel as claimed in claim 26, further comprising means for making, when said surface discharge electrodes of a predetermined number of one or more rows arranged successively in the column direction are defined as a set, feeding directions of the sustain pulses opposite to each other between said surface discharge electrodes of odd-numbered sets and even-numbered sets.

39. A plasma display panel as claimed in claim 26, further comprising means for making the polarities of voltages applied as the sustain pulses to adjacent electrodes of said scanning electrodes and said sustain electrodes on boundaries between odd-numbered sets and even-numbered sets of said surface discharge electrodes of the same polarity.

40. A plasma display panel as claimed in claim 26, further comprising means for making the polarities of voltages applied as the sustain pulses to adjacent electrodes of said scanning electrodes on boundaries between odd-numbered sets and even-numbered sets of said surface discharge electrodes of the same polarity.

41. A plasma display panel as claimed in claim 26, further comprising means for making the polarities of voltages applied as the sustain pulses to adjacent electrodes of said sustain electrodes on boundaries between odd-numbered sets and even-numbered sets of said surface discharge electrodes of the same polarity.

42. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written; and pulse feeding control means for causing voltages, whose positive and negative polarities are opposite to each other, to be applied to said scanning electrodes and said sustain electrodes as the sustain pulses to be fed to said surface discharge electrodes, wherein said sustain pulse feeding means is connected to the opposite ends of said scanning electrodes.

43. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written; and pulse feeding control means for causing voltages, whose positive and negative polarities are opposite to each other, to be applied to said scanning electrodes and said sustain electrodes as the sustain pulses to be fed to said surface discharge electrodes, wherein said sustain pulse feeding means is connected to the opposite ends of said sustain electrodes.

44. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written; and pulse feeding control means for causing voltages, whose positive and negative polarities are opposite to each other, to be applied to said scanning electrodes and said sustain electrodes as the sustain pulses to be fed to said surface discharge electrodes, wherein, when a pair of adjacent electrodes of said surface discharge electrodes of comprise odd-numbered set and an even-numbered set are defined as a group, wiring line structures for said scanning electrodes and said sustain electrodes are symmetrical in the row direction between odd-numbered groups and even-numbered groups of said surface discharge electrodes.

45. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written; and pulse feeding control means for causing voltages, whose positive and negative polarities are opposite to each other, to be applied to said scanning electrodes and said sustain electrodes as the sustain pulses to be fed to said surface discharge electrodes, wherein, when said surface discharge electrodes of a predetermined number of one or more rows arranged successively in the column direction are defined as a set, orders of said scanning electrodes and said sustain electrodes are alternately opposite to each other between odd-numbered sets and even-numbered sets of said surface discharge electrodes.

46. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written;

pulse feeding control means for causing voltages, whose positive and negative polarities are opposite to each other, to be applied to said scanning electrodes and said sustain electrodes as the sustain pulses to be fed to said surface discharge electrodes; and means for making, when said surface discharge electrodes of a predetermined number of one or more rows arranged successively in the column direction are defined as a set, feeding directions of the sustain pulses opposite to each other between said surface discharge electrodes of odd-numbered sets and even-numbered sets.

47. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written;

pulse feeding control means for causing voltages, whose positive and negative polarities are opposite to each other, to be applied to said scanning electrodes and said sustain electrodes as the sustain pulses to be fed to said surface discharge electrodes; and means for making the polarities of voltages applied as the sustain pulses to adjacent electrodes of the scanning electrodes and the sustain electrodes on boundaries between odd-numbered sets and even-numbered sets of said surface discharge electrodes of the same polarity.

48. A plasma display panel comprising a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written;

pulse feeding control means for causing voltages, whose positive and negative polarities are opposite to each other, to be applied to said scanning electrodes and said sustain electrodes as the sustain pulses to be fed to said surface discharge electrodes; and means for making the polarities of voltages applied as the sustain pulses to adjacent electrodes of said scanning electrodes on boundaries between odd-numbered sets and even-numbered sets of said surface discharge electrodes of the same polarity.

49. A plasma display panel comprising:

a plurality of surface discharge electrodes each including a scanning electrode and a sustain electrode, and successively arranged in the column direction parallel to the row direction;

a plurality of data electrodes successively arranged in the row direction parallel to the column direction and forming pixels at positions at which said data electrodes intersect with said surface discharge electrodes;

a discharge space located in a gap between the plane on which said plurality of data electrodes are arranged and the plane on which said plurality of surface discharge electrodes are arranged;

wall charge writing means for successively applying scanning pulses to said plurality of scanning electrodes and successively applying data pulses corresponding to an image to said plurality of data electrodes to write wall charge into the pixels corresponding to the image;

sustain pulse feeding means for feeding alternating sustain pulses, whose feeding directions are reversed between a first condition and a second condition, between said scanning electrodes and said sustain electrodes to cause discharge to occur at the positions of the pixels in which the wall charge is written;

pulse feeding control means for causing voltages, whose positive and negative polarities are opposite to each other, to be applied to said scanning electrodes and said sustain electrodes as the sustain pulses to be fed to said surface discharge electrodes; and means for malting the polarities of voltages applied as the sustain pulses to adjacent electrodes of said sustain electrodes on boundaries between odd-numbered sets and even-numbered sets of said surface discharge electrodes of the same polarity.

* * * * *